US009016400B2

(12) United States Patent
Clausen et al.

(10) Patent No.: US 9,016,400 B2
(45) **Date of Patent: *Apr. 28, 2015**

(54) DOWNHOLE ROTARY DRILLING APPARATUS WITH FORMATION-INTERFACING MEMBERS AND CONTROL SYSTEM

(75) Inventors: Jeffery Clausen, Houston, TX (US); Jonathan Ryan Prill, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 818 days.

This patent is subject to a terminal disclaimer.

(21) Appl. No.: 13/229,643

(22) Filed: Sep. 9, 2011

(65) Prior Publication Data

US 2012/0061148 A1 Mar. 15, 2012

Related U.S. Application Data

(60) Provisional application No. 61/381,243, filed on Sep. 9, 2010, provisional application No. 61/410,099, filed on Nov. 4, 2010.

(51) Int. Cl.

| | |
|---|---|
| ***E21B 7/06*** | (2006.01) |
| ***E21B 7/04*** | (2006.01) |
| ***E21B 17/10*** | (2006.01) |

(52) U.S. Cl.

CPC ..... *E21B 17/1014* (2013.01); *E21B 7/06* (2013.01)

(58) Field of Classification Search

CPC ..... E21B 7/06; E21B 7/04; E21B 7/062; E21B 7/067; E21B 7/046; E21B 7/061

USPC ..... 175/61, 76, 62, 73

See application file for complete search history.

(56) References Cited

U.S. PATENT DOCUMENTS

| | | | |
|---|---|---|---|
| 2,579,670 | A | 12/1951 | George |
| 2,942,578 | A | 6/1960 | Huffman et al. |

(Continued)

FOREIGN PATENT DOCUMENTS

| | | | |
|---|---|---|---|
| CA | 1144916 | A1 | 4/1983 |
| CA | 2011972 | A1 | 9/1990 |

(Continued)

OTHER PUBLICATIONS

Colebrook, M.A., et al., "Application of Steerable Rotary Drilling Technology to Drill Extended Reach Wells," 1998 IADC/SPE Drilling Conference, Dallas, Texas, Mar. 3-6, 1998 (SPE 39327) (11 p.).

(Continued)

*Primary Examiner* — Kenneth L Thompson
*Assistant Examiner* — Wei Wang
(74) *Attorney, Agent, or Firm* — Conley Rose, P.C.

(57) ABSTRACT

A steerable drilling apparatus includes a control system inside a cylindrical housing connected to a drill bit having radially-extendable pistons. A fluid-metering assembly directs a piston actuating fluid into fluid channels in the drill bit leading to respective pistons. The control system controls the fluid-metering assembly to selectively allow fluid flow through the fluid channels to the pistons and to exit through orifices in the fluid channels. The selective fluid flow causes the actuated piston to temporarily extend in the opposite direction to a desired wellbore deviation, thereby deflecting the drill bit away from the borehole centerline. An upper member in the fluid-metering assembly can be moved to stabilize, steer, and change TFA within the drill bit. The control system and drill bit are connected so as to facilitate removal to change the drill bit's steering section and cutting structure configuration or gauge simultaneously.

40 Claims, 23 Drawing Sheets

(56) References Cited

U.S. PATENT DOCUMENTS 3,030,930 A 4/1962 Louis
3,089,551 A 5/1963 Greene
3,092,188 A 6/1963 Farris et al.
3,195,660 A 7/1965 McKown
3,298,449 A 1/1967 Bachman et al.
3,424,256 A 1/1969 Jeter et al.
3,488,765 A 1/1970 Anderson
3,502,002 A 3/1970 Whiteman, Jr.
3,780,622 A 12/1973 Vogel
3,880,051 A 4/1975 Eppler
3,913,488 A 10/1975 Dunetz et al.
3,973,472 A 8/1976 Russell, Jr.
3,997,008 A 12/1976 Kellner
4,040,494 A 8/1977 Kellner
4,096,911 A 6/1978 Geske
4,281,723 A 8/1981 Edmond et al.
4,336,850 A 6/1982 Fielder
4,394,881 A 7/1983 Shirley
4,460,324 A 7/1984 Van Appledorn
4,532,853 A 8/1985 Stangroom
4,610,318 A 9/1986 Goodfellow
4,635,736 A 1/1987 Shirley
4,690,229 A 9/1987 Raney
4,721,172 A 1/1988 Brett et al.
4,819,745 A 4/1989 Walter
5,181,576 A 1/1993 Askew et al.
5,265,682 A 11/1993 Russell et al.
5,265,684 A 11/1993 Rosenhauch
5,293,945 A 3/1994 Rosenhauch et al.
5,311,953 A 5/1994 Walker
5,334,062 A 8/1994 Lurbiecki
5,379,852 A 1/1995 Strange, Jr.
5,421,420 A 6/1995 Malone et al.
5,467,834 A 11/1995 Hughes et al.
5,511,627 A 4/1996 Anderson
5,513,713 A 5/1996 Groves
5,520,255 A 5/1996 Barr et al.
5,520,256 A 5/1996 Eddison
5,542,482 A 8/1996 Eddison
5,553,678 A 9/1996 Barr et al.
5,582,260 A 12/1996 Murer et al.
5,704,284 A 1/1998 Stollenwerk
5,706,905 A 1/1998 Barr
5,775,443 A 7/1998 Lott
5,778,992 A 7/1998 Fuller
5,803,185 A 9/1998 Barr et al.
5,971,085 A 10/1999 Colebrook
6,092,610 A 7/2000 Kosmala et al.
6,109,372 A 8/2000 Dorel et al.
6,158,529 A 12/2000 Dorel
6,158,533 A 12/2000 Gillis et al.
6,196,339 B1 3/2001 Portwood et al.
6,254,275 B1 7/2001 Slaughter, Jr. et al.
6,279,670 B1 8/2001 Eddison et al.
6,290,003 B1 9/2001 Russell
6,315,063 B1 11/2001 Martini
6,318,481 B1 11/2001 Schoeffler
6,390,192 B2 5/2002 Doesburg et al.
6,390,212 B1 5/2002 Wood
6,408,957 B1 6/2002 Slaughter et al.
6,431,292 B2 8/2002 Mocivnik et al.
6,439,318 B1 8/2002 Eddison et al.
6,484,823 B2 11/2002 Olsson et al.
6,516,900 B1 2/2003 Tokle
6,520,254 B2 2/2003 Hurst et al.
6,520,271 B1 2/2003 Martini
6,571,679 B2 6/2003 Atkinson
6,571,888 B2 6/2003 Comeau et al.
6,609,579 B2 8/2003 Krueger et al.
6,626,254 B1 9/2003 Krueger et al.
6,695,063 B2 2/2004 Lauritzen et al.
6,715,570 B1 4/2004 Downton et al.
6,789,624 B2 9/2004 McGregor et al.
6,840,336 B2 1/2005 Schaaf et al.
6,843,319 B2 1/2005 Tran et al.
6,848,518 B2 2/2005 Chen et al.
6,851,475 B2 2/2005 Simpson et al.
6,962,214 B2 11/2005 Hughes et al.
6,997,272 B2 2/2006 Eppink
7,004,263 B2 2/2006 Moriarty et al.
7,004,266 B2 2/2006 Russell et al.
7,028,789 B2 4/2006 Krueger et al.
7,040,395 B2 5/2006 Booth et al.
7,048,061 B2 5/2006 Bode et al.
7,090,033 B2 8/2006 Chan et al.
7,100,690 B2 9/2006 Mullen et al.
7,188,687 B2 3/2007 Rudd et al.
7,243,740 B2 7/2007 Frith
7,275,605 B2 10/2007 Smith et al.
7,287,605 B2 10/2007 Van Steenwyk et al.
7,306,060 B2 12/2007 Krueger et al.
7,308,944 B2 12/2007 Johnston et al.
7,360,609 B1 4/2008 Falgout, Sr.
7,389,830 B2 6/2008 Turner et al.
7,413,034 B2 8/2008 Kirkhope et al.
7,503,405 B2 3/2009 Hall et al.
7,555,978 B2 7/2009 Hiez et al.
7,644,766 B2 1/2010 Begley et al.
7,681,665 B2 3/2010 Eppink
7,708,062 B2 5/2010 Carro
7,730,972 B2 6/2010 Hall et al.
7,748,463 B2 7/2010 Revheim
7,757,781 B2 7/2010 Hay et al.
7,810,585 B2 10/2010 Downton
7,832,476 B2 11/2010 Schafer et al.
7,849,936 B2 * 12/2010 Hutton ..... 175/61
7,878,267 B2 2/2011 Southard
7,878,272 B2 2/2011 Eppink
7,926,592 B2 4/2011 Smith et al.
7,931,098 B2 4/2011 Aronstam et al.
7,942,214 B2 5/2011 Johnson et al.
7,954,555 B2 6/2011 Ashy et al.
7,971,662 B2 7/2011 Beuershausen
8,011,452 B2 9/2011 Downton
8,020,637 B2 9/2011 Hall et al.
8,087,479 B2 1/2012 Kulkarni et al.
8,100,199 B2 1/2012 Braddick
8,104,549 B2 1/2012 Lee
8,141,657 B2 3/2012 Hutton
8,181,719 B2 5/2012 Bunney et al.
8,205,686 B2 * 6/2012 Beuershausen ..... 175/57
8,240,399 B2 8/2012 Kulkarni et al.
8,251,144 B2 8/2012 MacFarlane
8,297,358 B2 10/2012 Korkmaz et al.
8,302,703 B2 11/2012 Rolovic
8,333,254 B2 12/2012 Hall et al.
8,342,250 B2 1/2013 Blair et al.
8,365,821 B2 2/2013 Hall et al.
8,376,067 B2 2/2013 Downton et al.
8,448,722 B2 5/2013 Konschuh et al.
8,528,649 B2 9/2013 Kolle
8,528,664 B2 9/2013 Hall et al.
8,590,636 B2 11/2013 Menger
8,672,036 B2 3/2014 Hughes et al.
8,672,042 B2 3/2014 Braddick
8,672,056 B2 3/2014 Clark et al.
8,708,064 B2 4/2014 Downton et al.
2002/0179336 A1 12/2002 Schaaf et al.
2003/0015352 A1 1/2003 Robin et al.
2003/0042022 A1 3/2003 Lauritzen et al.
2004/0118571 A1 6/2004 Lauritzen et al.
2006/0090935 A1 5/2006 Van Steenwyk et al.
2006/0130643 A1 6/2006 Frank
2006/0157281 A1 7/2006 Downton
2006/0207798 A1 9/2006 Smith et al.
2006/0231291 A1 10/2006 Johannessen
2006/0254825 A1 11/2006 Krueger et al.
2009/0126936 A1 5/2009 Begley et al.
2009/0133931 A1 5/2009 Rolovic
2009/0260884 A1 10/2009 Santelmann
2010/0006341 A1 1/2010 Downton
2010/0163307 A1 7/2010 Schwefe et al.
2010/0270079 A1 10/2010 Southard
2011/0061938 A1 3/2011 Miszewski

(56) References Cited

U.S. PATENT DOCUMENTS

| | | | |
|---|---|---|---|
| 2011/0139513 | A1 | 6/2011 | Downton |
| 2011/0240369 | A1 | 10/2011 | Hall et al. |
| 2011/0240377 | A1 | 10/2011 | Hall et al. |
| 2012/0061148 | A1 | 3/2012 | Clausen et al. |
| 2012/0067592 | A1 | 3/2012 | Niina et al. |
| 2012/0080234 | A1 | 4/2012 | Hall et al. |
| 2012/0168229 | A1 | 7/2012 | Lee |
| 2012/0175106 | A1 | 7/2012 | Rankin |
| 2012/0175168 | A1 | 7/2012 | Lee |
| 2012/0186878 | A1 | 7/2012 | Eddison |
| 2012/0261190 | A1 | 10/2012 | Krueger, IV et al. |
| 2013/0092246 | A1 | 4/2013 | Kolle |
| 2013/0118812 | A1 | 5/2013 | Clausen et al. |
| 2013/0133956 | A1 | 5/2013 | Jones et al. |
| 2013/0161102 | A1 | 6/2013 | Zhou |
| 2013/0206401 | A1 | 8/2013 | Bhoite et al. |
| 2013/0213646 | A1 | 8/2013 | Angman et al. |
| 2013/0255960 | A1 | 10/2013 | Fripp et al. |
| 2013/0277043 | A1 | 10/2013 | Hallundaek et al. |
| 2013/0284428 | A1 | 10/2013 | Xu |
| 2013/0292175 | A1 | 11/2013 | Radford et al. |
| 2013/0306319 | A1 | 11/2013 | Kolle |
| 2014/0014413 | A1 | 1/2014 | Niina et al. |
| 2014/0020955 | A1 | 1/2014 | Cramer et al. |
| 2014/0041943 | A1 | 2/2014 | Lanning et al. |
| 2014/0048282 | A1 | 2/2014 | Dykstra et al. |
| 2014/0110178 | A1 | 4/2014 | Savage et al. |

FOREIGN PATENT DOCUMENTS

| | | | |
|---|---|---|---|
| CA | 1306244 | C | 8/1992 |
| CA | 2060445 | A1 | 8/1992 |
| CA | 2123700 | A1 | 6/1993 |
| CA | 2124442 | A1 | 6/1993 |
| CA | 2128903 | A1 | 6/1994 |
| CA | 2161312 | A1 | 5/1996 |
| CA | 2167795 | A1 | 7/1996 |
| CA | 2234495 | A1 | 10/1999 |
| CA | 2355815 | C | 11/2005 |
| CA | 2291600 | C | 4/2006 |
| CA | 2387299 | C | 4/2006 |
| CA | 2452907 | C | 7/2006 |
| CA | 2606428 | A1 | 11/2006 |
| CA | 2254044 | C | 3/2007 |
| CA | 2376823 | C | 5/2007 |
| CA | 2570716 | A1 | 6/2007 |
| CA | 2254741 | C | 7/2007 |
| CA | 2637410 | A1 | 7/2007 |
| CA | 2279338 | C | 8/2007 |
| CA | 2661518 | A1 | 4/2008 |
| CA | 2483812 | C | 9/2008 |
| CA | 2656848 | A1 | 9/2009 |
| CA | 2657012 | A1 | 9/2009 |
| CA | 2722762 | A1 | 10/2009 |
| CA | 2379806 | C | 11/2009 |
| CA | 2741618 | A1 | 5/2010 |
| CA | 2764300 | A1 | 12/2010 |
| CA | 2769937 | A1 | 2/2011 |
| CA | 2680895 | A1 | 3/2011 |
| CA | 2804747 | A1 | 1/2012 |
| CA | 2810266 | A1 | 3/2012 |
| CA | 2483174 | C | 4/2012 |
| CA | 2762538 | A1 | 6/2012 |
| CA | 2762559 | A1 | 6/2012 |
| CA | 2762607 | A1 | 6/2012 |
| CA | 2821835 | A1 | 6/2012 |
| CA | 2765055 | A1 | 7/2012 |
| CA | 2828745 | A1 | 10/2012 |
| CA | 2832212 | A1 | 10/2012 |
| CA | 2689578 | C | 12/2012 |
| CA | 2746918 | A1 | 1/2013 |
| CA | 2638234 | C | 6/2013 |
| CA | 2806898 | A1 | 8/2013 |
| CA | 2737504 | C | 9/2013 |
| CA | 2706850 | C | 10/2013 |
| CA | 2701474 | C | 12/2013 |
| CA | 2820491 | A1 | 12/2013 |
| CN | 2039734 | U | 6/1989 |
| CN | 1124515 | A | 6/1996 |
| EP | 0333484 | A2 | 9/1989 |
| EP | 0497422 | B1 | 6/1996 |
| EP | 0728907 | A2 | 8/1996 |
| EP | 0747570 | A1 | 12/1996 |
| EP | 0624225 | B1 | 3/1997 |
| EP | 0601811 | B1 | 10/1997 |
| EP | 0686752 | B1 | 5/2000 |
| EP | 0728911 | B1 | 7/2001 |
| EP | 0954674 | B1 | 9/2001 |
| EP | 0710764 | B1 | 7/2002 |
| EP | 1264960 | A2 | 12/2002 |
| EP | 1024245 | B1 | 10/2004 |
| EP | 1106777 | B1 | 3/2006 |
| EP | 1588021 | B1 | 8/2006 |
| EP | 1815104 | A1 | 8/2007 |
| EP | 0927295 | B1 | 3/2008 |
| EP | 1974120 | A1 | 10/2008 |
| EP | 2173960 | A1 | 4/2010 |
| EP | 2198109 | A2 | 6/2010 |
| EP | 1923534 | B1 | 11/2010 |
| EP | 2098680 | B1 | 7/2011 |
| EP | 2466058 | A1 | 6/2012 |
| EP | 1247787 | B1 | 10/2012 |
| EP | 2467556 | B1 | 6/2013 |
| EP | 2607616 | A1 | 6/2013 |
| EP | 2614209 | A1 | 7/2013 |
| GB | 2005773 | A | 4/1979 |
| GB | 2419616 | A | 5/2006 |
| WO | 2009/002996 | A1 | 12/2008 |
| WO | 2009002996 | A1 | 12/2008 |
| WO | 2009151786 | A2 | 12/2009 |

OTHER PUBLICATIONS

PCT/CA2011/001006 International Search Report and Written Opinion dated Dec. 28, 2011 (9 p.).

PCT/CA2011/001006 International Preliminary Report on Patentability dated Jan. 2, 2013 (12 p.).

Chinese Office Action dated Jul. 16, 2014; Chinese Application No. 201180051342.0 (5 p.).

PCT/US2013/069985 International Search Report and Written Opinion dated Nov. 13, 2014 (11 p.).

European Search Report dated Oct. 24, 2014; European Application No. 11822954.1 (6 p.).

* cited by examiner

FIG. 14A
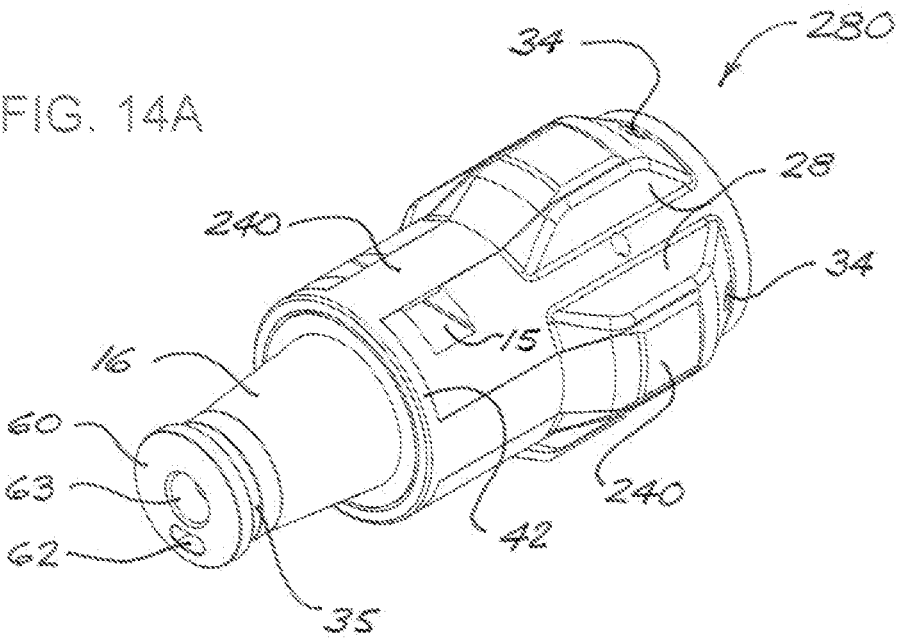
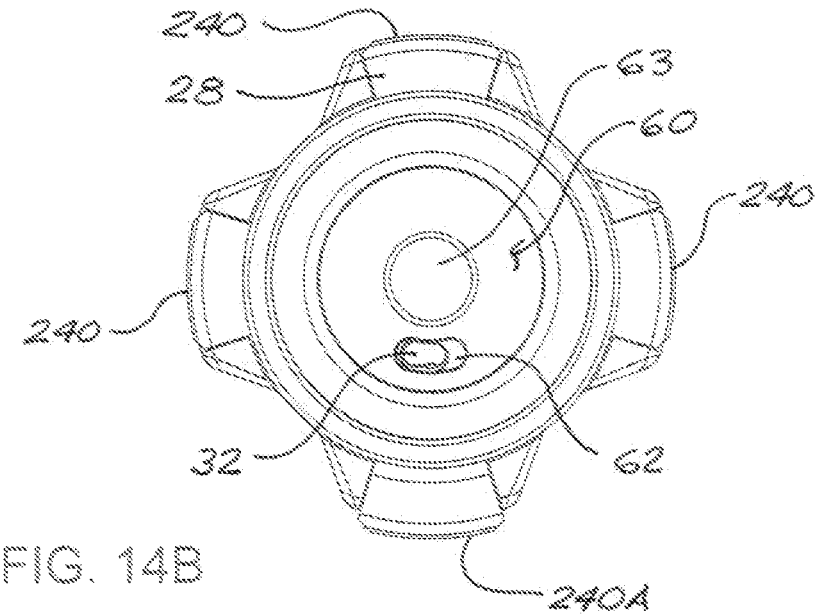
FIG. 14B

FIG. 15A
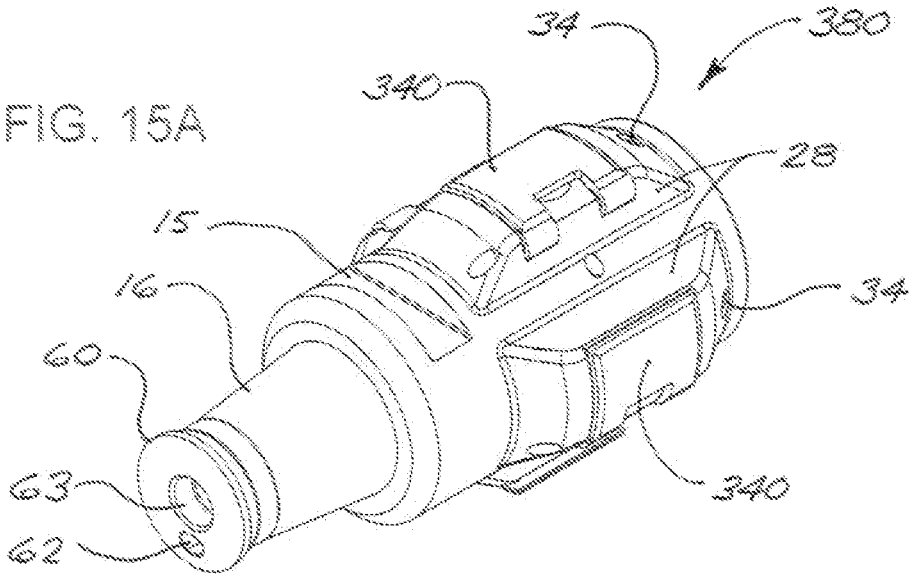
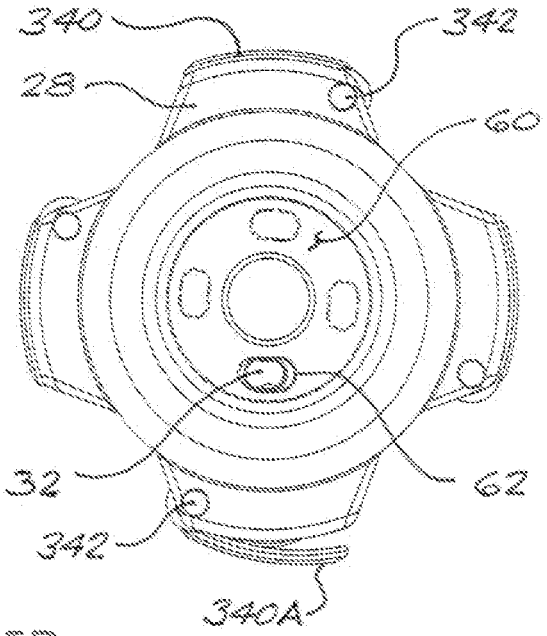
FIG. 15B

DOWNHOLE ROTARY DRILLING APPARATUS WITH FORMATION-INTERFACING MEMBERS AND CONTROL SYSTEM

CROSS-REFERENCE TO RELATED APPLICATIONS

This application claims the benefit of U.S. Provisional Application No. 61/381,243 , filed on Sep. 9, 2010 , and U.S. Provisional Application No. 61/410,099 , filed on Nov. 4, 2010 , and said earlier applications are incorporated herein by reference in their entirety for continuity of disclosure.

FIELD OF THE DISCLOSURE

The present disclosure relates in general to systems and apparatus for directional drilling of wellbores, particularly for oil and gas wells.

BACKGROUND

Rotary steerable systems (RSS) currently used in drilling oil and gas wells into subsurface formations commonly use tools that operate above the drill bit as completely independent tools controlled from the surface. These tools are used to steer the drill string in a desired direction away from a vertical or other desired wellbore orientation, such as by means of steering pads or reaction members that exert lateral forces against the wellbore wall to deflect the drill bit relative to wellbore centerline. Most of these conventional systems are complex and expensive, and have limited run times due to battery and electronic limitations. They also require the entire tool to be transported from the well site to a repair and maintenance facility when parts of the tool break down. Most currently-used designs require large pressure drops across the tool for the tools to work well. Currently there is no easily separable interface between RSS control systems and formation-interfacing reaction members that would allow directional control directly at the bit.

There are two main categories of rotary steerable drilling systems used for directional drilling. In "point-the-bit" drilling systems, the orientation of the drill bit is varied relative to the centerline of the drill string to achieve a desired wellbore deviation. In "push-the-bit" systems, a lateral or side force is applied to the drill string (typically at a point several feet above the drill bit), thereby deflecting the bit away from the local axis of the wellbore to achieve a desired deviation.

Rotary steerable systems (RSS) currently used for directional drilling focus on tools that sit above the drill bit and either push the bit with a constant force several feet above the bit, or point the bit in order to steer the bit in the desired direction. Push-the-bit systems are simpler and more robust, but have limitations due to the applied side force being several feet from the bit and thus requiring the application of comparatively large forces to deflect the bit. As a matter of basic physics, the side force necessary to induce a given bit deflection (and, therefore, a given change in bit direction) will increase as the distance between the side force and the bit increases.

Examples of prior art RSS systems may be found in U.S. Pat. No. 4,690,229 (Raney); U.S. Pat. No. 5,265,682 (Russell et al.); U.S. Pat. No. 5,513,713 (Groves); U.S. Pat. No. 5,520,255 (Barr et al.); U.S. Pat. No. 5,553,678 (Ban et al.); U.S. Pat. No. 5,582,260 (Murer et al.); U.S. Pat. No. 5,706,905 (Barr); U.S. Pat. No. 5,778,992 (Fuller); U.S. Pat. No. 5,803,185 (Barr et al.); U.S. Pat. No. 5,971,085 (Colebrook); U.S. Pat. No. 6,279,670 (Eddison et al.); U.S. Pat. No. 6,439,318 (Eddison et al.); U.S. Pat. No. 7,413,034 (Kirkhope et al.); U.S. Pat. No. 7,287,605 (Van Steenwyk et al.); U.S. Pat. No. 7,306,060 (Krueger et al.); U.S. Pat. No. 7,810,585 (Downton); and U.S. Pat. No. 7,931,098 (Aronstam et al.), and in Int'l Application No. PCT/US2008/068100 (Downton), published as Int'l Publication No. WO 2009/002996 A1.

Currently-used RSS designs typically require large pressure drops across the bit, thus limiting hydraulic capabilities in a given well due to increased pumping horsepower requirements for circulating drilling fluid through the apparatus. Point-the-bit systems may offer performance advantages over push-the-bit systems, but they require complex and expensive drill bit designs; moreover, they can be prone to bit stability problems in the wellbore, making them less consistent and harder to control, especially when drilling through soft formations.

A push-the-bit system typically requires the use of a filter sub run above the tool to keep debris out of critical areas of the apparatus. Should large debris (e.g., rocks) or large quantities of lost circulation material (e.g., drilling fluid) be allowed to enter the valve arrangements in current push-the-bit tool designs, valve failure is typically the result. However, filter subs are also prone to problems; should lost circulation material or rocks enter and plug up a filter sub, it may be necessary to remove (or "trip") the drill string and bit from the wellbore in order to clean out the filter.

For the foregoing reasons, there is a need for rotary steerable push-the-bit drilling systems and apparatus that can deflect the drill bit to a desired extent applying lower side forces to the drill string than in conventional push-the-bit systems, while producing less pressure drop across the tool than occurs using known systems. There is also a need for rotary steerable push-the-bit drilling systems and apparatus that can operate reliably without needing to be used in conjunction with filter subs.

Push-the-bit RSS designs currently in use typically incorporate an integral RSS control system or apparatus for controlling the operation of the RSS tool. It is therefore necessary to disconnect the entire RSS apparatus from the drill string and replace it with a new one whenever it is desired to change bit sizes. This results in increased costs and lost time associated with bit changes. Accordingly, there is also a need for push-the-bit RSS designs in which the RSS control apparatus is easily separable from the steering mechanism and can be used with multiple drill bit sizes.

There is a further need for push-the-bit RSS systems and apparatus that can be selectively operated in either a first mode for directional drilling, or a second mode in which the steering mechanism is turned off for purposes of straight, non-deviated drilling. Such operational mode selectability will increase service life of the apparatus as well as the time between tool change-outs in the field. In addition, there is a need for such systems and apparatus that use a field-serviceable modular design, allowing the control system and components of the pushing system to be changed out in the field, thereby providing increased reliability and flexibility to the field operator, and at lower cost.

BRIEF SUMMARY

In general terms, the present disclosure teaches embodiments of push-the-bit rotary steerable drilling apparatus (alternatively referred to as an RSS tool) comprising a drill bit having a cutting structure, a pushing mechanism (or "steering section") for laterally deflecting the cutting structure by applying a side force to the drill bit, and a control assembly for actuating the bit-pushing mechanism. As used in this patent specification, the term "drill bit" is to be understood as including both the cutting structure and the steering section, with the cutting structure being connected to the lower end of the steering section. The cutting structure may be permanently connected to or integral with the steering section, or may be demountable from the steering section.

The steering section of the drill bit houses one or more pistons, each having a radial stroke. The pistons are typically (but not necessarily) spaced uniformly around the circumference of the bit, and adapted for extension radially outward from the main body of the steering section. In some embodiments, the pistons are adapted for direct contact with the wall of a wellbore drilled into a subsurface formation. In other embodiments, a reaction member (alternatively referred to as a reaction pad) may be provided for each piston, with the outer surfaces of the reaction members lying in a circular pattern generally corresponding to the diameter (i.e., gauge) of the wellbore and the drill bit's cutting structure. Each reaction member is mounted to the steering section so as to extend over at least a portion of the outer face of the associated piston, such that when a given piston is extended, it reacts against the inner surface of its reaction member. The outer surface of the reaction member in turn reacts against the wall of the wellbore, such that the side force induced by extension of the piston will push or deflect the bit's cutting structure in a direction away from the extended piston, toward the opposite side of the wellbore. The reaction members are mounted to the steering section in a non-rigid or resilient fashion so as to be outwardly deflectable relative to the steering section, in order to induce lateral displacement of the cutting structure relative to the wellbore when a given piston is actuated. The pistons may be biased toward retracted positions within the steering section, such as by means of biasing springs.

The steering section is formed with one or more fluid channels, corresponding in number to the number of pistons, and each extending between the radially-inward end of a corresponding piston to a fluid inlet at the upper end of the steering section, such that a piston-actuating fluid (such as drilling mud) can enter any given fluid channel to actuate the corresponding piston. The fluid channels typically continue downward past the pistons to allow fluid to exit into the wellbore through terminal bit jets.

The control assembly of the RSS tool is disposed within a housing, the lower end of which connects to the upper end of the steering section. A piston-actuating fluid such as drilling mud flows downward through the housing and around the steering section. The lower end of the control assembly engages and actuates a fluid-metering assembly for directing piston-actuating fluid to one (or more) of the pistons via the corresponding fluid channels in the steering section.

In one embodiment of the RSS tool, the fluid-metering assembly comprises a generally cylindrical upper sleeve member having an upper flange and a fluid-metering slot or opening in the sleeve below the flange. The fluid-metering assembly also comprises a lower sleeve having a center bore and defining the required number of fluid inlets, with each fluid inlet being open to the center bore via an associated recess in an upper region of the lower sleeve. The lower sleeve is mounted to or integral with the upper end of the steering section. The upper sleeve is disposable within the bore of the lower sleeve, with the slot in the upper sleeve at generally the same height as the recesses in the lower sleeve. The control assembly is adapted to engage and rotate the upper sleeve within the lower sleeve, such that piston-actuating fluid will flow from the housing into the upper sleeve, and then will be directed via the slot in the upper sleeve into a recess with which the slot is aligned, and thence into the corresponding fluid inlet and downward within the corresponding fluid channel in the steering section to actuate (i.e., to radially extend) the corresponding piston.

The housing and the drill bit will rotate with the drill string, but the control assembly is adapted to control the rotation of the upper sleeve relative to the housing. To use the apparatus to deflect or deviate a wellbore in a specific direction, the control assembly controls the rotation of the upper sleeve to keep it in a desired angular orientation relative to the wellbore, irrespective of the rotation of the drill string. In this operational mode, the fluid-metering slot in the upper sleeve will remain oriented in a selected direction relative to the earth; i.e., opposite to the direction in which it is desired to deviate the wellbore. As the lower sleeve rotates below and relative to the upper sleeve, piston-actuating fluid will be directed sequentially into each of the fluid inlets, thus actuating each piston to exert a force against the wall of the wellbore, thus pushing and deflecting the bit's cutting structure in the opposite direction relative to the wellbore. With each momentary alignment of the upper sleeve's fluid-metering slot with one of the fluid inlets, fluid will flow into that fluid inlet and actuate the corresponding piston to deflect the cutting structure in the desired lateral direction (i.e., toward the side of the wellbore opposite the actuated piston). Accordingly, with each rotation of the drill string, the cutting structure will be subjected to a number of momentary pushes corresponding to the number of fluid inlets and pistons.

In a variant embodiment, the upper and lower sleeves are adapted and proportioned such that the upper sleeve is axially movable relative to the lower sleeve, from an upper position permitting fluid to flow into all fluid inlets simultaneously, to an intermediate position permitting fluid flow into only one fluid inlet at a time, and to a lower position preventing fluid flow into any of the fluid inlets (in which case all of the fluid simply continues to flow downward to the cutting structure through a central bore or channel in the steering section).

In another embodiment of the RSS tool, the fluid-metering assembly comprises an upper plate that is coaxially rotatable (by means of the control assembly) above a fixed lower plate incorporated into the upper end of the steering section, with the fixed lower plate defining the required number of fluid inlets, which are arrayed in a circular pattern concentric with the longitudinal axis (i.e., centerline) of the steering section, and aligned with corresponding fluid channels in the steering section. The upper and lower plates are preferably made from tungsten carbide or another wear-resistant material. The upper plate has a single fluid-metering opening extending through it, offset a radial distance generally corresponding to the radius of the fluid inlets in the fixed lower plate. As the tool housing and the drill bit rotate with the drill string, the control assembly controls the rotation of the upper plate to keep it in a desired angular orientation relative to the wellbore, irrespective of the rotation of the drill string.

The rotating upper plate lies immediately above and parallel to the fixed lower plate, such that when the fluid-metering opening in the upper plate is aligned with a given one of the fluid inlets in the fixed lower plate, piston-actuating fluid can flow through the fluid-metering opening in the upper plate and the aligned fluid inlet in the fixed lower plate, and into the corresponding fluid channel in the steering section. This fluid flow will cause the corresponding piston to extend radially outward from the steering section such that it reacts against its reaction member (or reacts directly against the wellbore), thus pushing and deflecting the bit's cutting structure in the opposite direction.

Preferably, the steering section of the drill bit is demountable from the control assembly (such as by means of a conventional pin-and-box threaded connection), with the rotating upper plate being incorporated into the control assembly. This facilitates field assembly of the components to complete the RSS tool at the drilling rig site, and facilitates quick drill bit changes at the rig site, either to use a different cutting structure, or to service the steering section, without having to remove the control assembly from the drill string.

To push the cutting structure in a desired direction relative to the wellbore, the control assembly is set to keep the fluid-metering opening oriented in the direction opposite to the desired pushing direction (i.e., direction of deflection). The drill bit is rotated within the wellbore, while the upper plate is non-rotating relative to the wellbore. With each rotation of the drill bit, the fluid-metering opening in the upper plate will pass over and be momentarily aligned with each of the fluid inlets in the fixed lower plate. Accordingly, when an actuating fluid is introduced into the interior of the tool housing above the upper plate, fluid will flow into each fluid channel in turn during each rotation of the drill string.

With each momentary alignment of the upper plate's fluid-metering opening with one of the fluid inlets, fluid will flow into that fluid inlet and actuate the corresponding piston to push (i.e., deflect) the cutting structure in the desired lateral direction (i.e., toward the side of the wellbore opposite the actuated piston). Accordingly, with each rotation of the drill string, the cutting structure will be subjected to a number of momentary pushes corresponding to the number of fluid inlets and pistons.

By means of the control assembly, the direction in which the cutting structure is pushed can be changed by rotating the upper plate to give it a different fixed orientation relative to the wellbore. However, if it is desired to use the tool for straight (i.e., non-deviated) drilling, the tool can be put into a straight-drilling mode (as further discussed later herein).

By having a side force applied directly at the drill bit, close to the cutting structure, rather than at a substantial distance above the bit as in conventional push-the-bit systems, bit steerability is enhanced, and the force needed to push the bit is reduced. Lower side forces at the bit, with a bit that is kept in line with the rest of the stabilized drill string behind, also increases stability and enhances repeatability in soft formations. The term "repeatability", as used in this patent specification, is understood in the directional drilling industry as denoting the ability to repeatably achieve a consistent curve radius (or "build rate") for the trajectory of a wellbore in a given subsurface formation, independent of the strength of the formation. The greater the magnitude of the force applied against the wall of a wellbore by a piston in a push-the-bit drilling system, the greater will be the tendency for the piston to cut into softer formations and reduce the curvature of the trajectory of the wellbore (as compared to the effect of similar forces in harder formations). Accordingly, this tendency in softer formations will be reduced by virtue of the lower piston forces required for equal effectiveness when using push-the-bit systems in accordance with the present disclosure.

Push-the-bit rotary steerable drilling systems and apparatus in accordance with the present disclosure may be of modular design, such that any of the various components (e.g., pistons, reaction members, control assembly, and control assembly components) can be changed out in the field during bit changes. As previously noted, another advantageous feature of the apparatus is that the rotating upper plate (or sleeve) of the fluid-metering assembly can be deactivated such that the tool will drill straight when deviation of the wellbore is not required, thereby promoting longer battery life (e.g., for battery-powered control assembly components) and thus extending the length of time that the tool can operate without changing batteries.

The control assembly for rotary steerable drilling apparatus in accordance with the present disclosure may be of any functionally suitable type. By way of one non-limiting example, the control assembly could be similar to or adapted from a fluid-actuated control assembly of the type in accordance with the vertical drilling system disclosed in International Application No. PCT/US2009/040983 (published as International Publication No. WO 2009/151786). In other embodiments, the control assembly could rotate the rotating upper plate or sleeve using, for example, an electric motor or opposing turbines.

BRIEF DESCRIPTION OF THE DRAWINGS

Embodiments in accordance with the present disclosure will now be described with reference to the accompanying Figures, in which numerical references denote like parts, and in which:

FIG. 14A is an isometric view of the steering section of the apparatus in FIG. 12, with a flexible reaction member mounted to the steering section in association with each piston.

FIG. 14B is a top end view of the apparatus in FIG. 14A, showing the upper and lower plates of the fluid-metering assembly, the piston housings, and the resiliently-mounted flexible reaction members.

FIG. 15A is an isometric view of the steering section of the apparatus in FIG. 12, with a hinged reaction member mounted to the steering section in association with each piston.

FIG. 15B is a top end view of the apparatus in FIG. 15A, showing the upper and lower plates of the piston-actuating mechanism, the piston housings, and the hinged reaction members.

FIG. 18A is a side view of the piston assembly in FIGS. 17A and 17B, shown in a retracted position.

DETAILED DESCRIPTION

Figure 1:
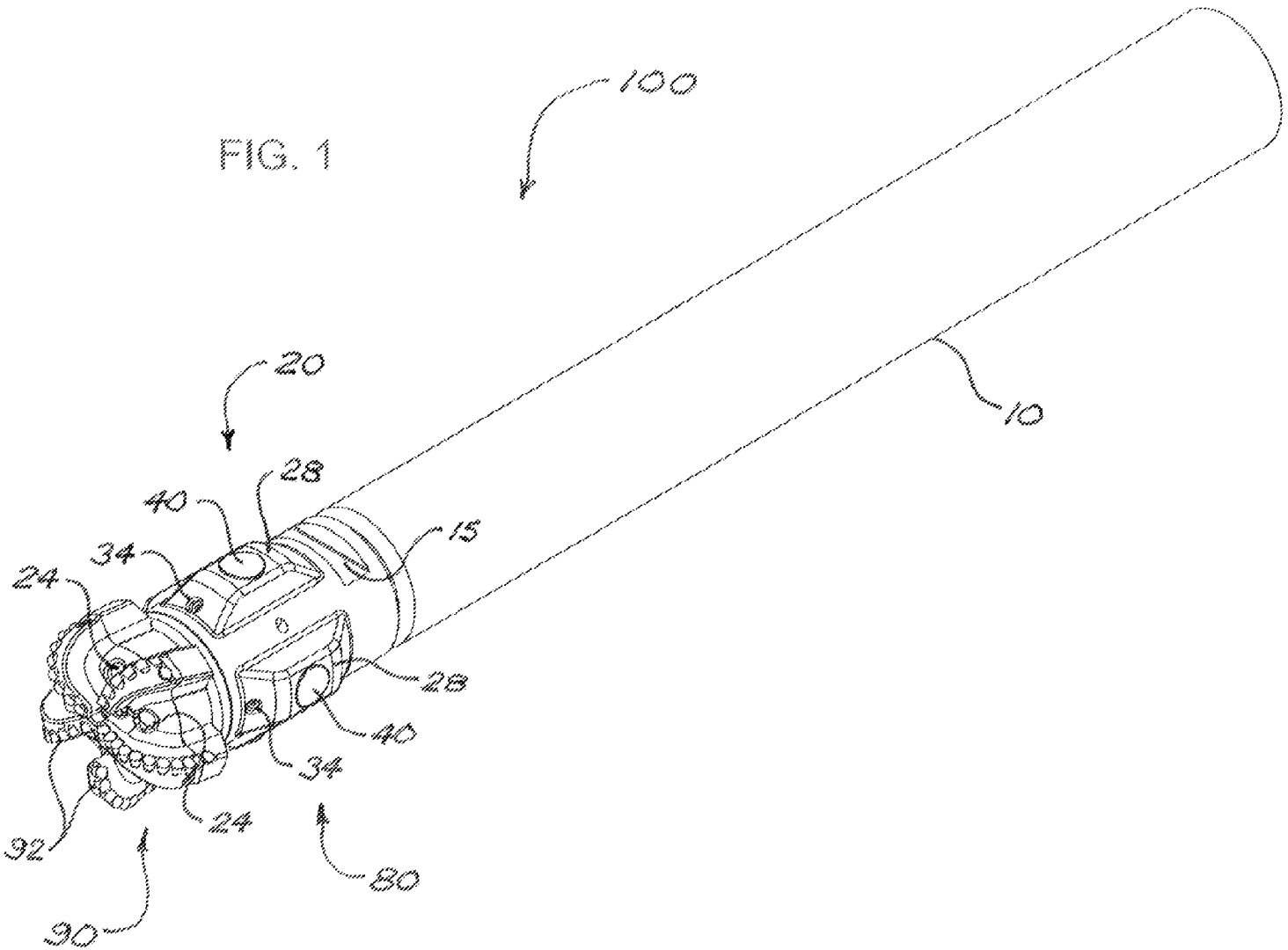
FIG. 1 is an isometric view of a first embodiment of a rotary drilling apparatus in accordance with the present disclosure, with bit-deflecting pistons adapted for direct contact with the wall of a wellbore.
Figure 2:
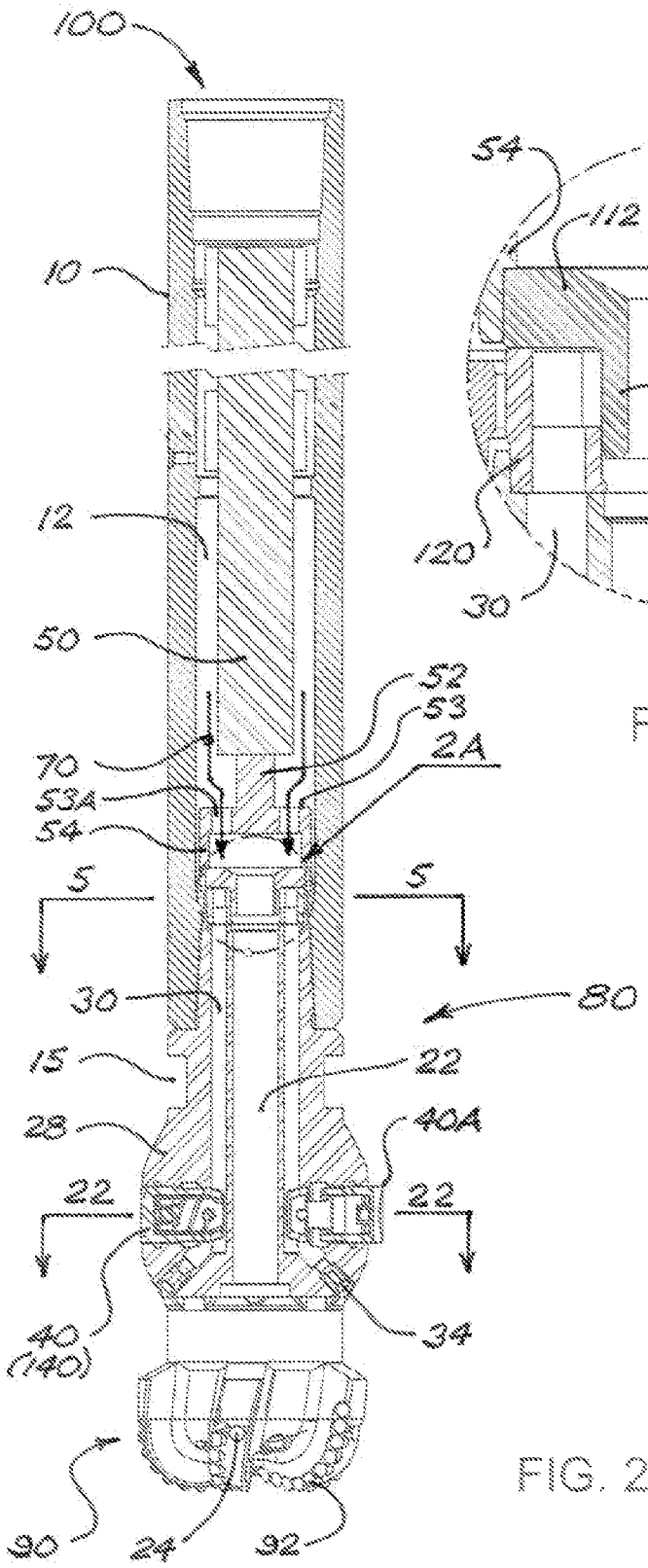
FIG. 2 is a longitudinal cross-section through a first variant of the rotary drilling apparatus in FIG. 1, in which the fluid-metering assembly comprises a rotating upper sleeve and a fixed lower sleeve.

FIGS. 1 and 2 illustrate (in isometric and cross-sectional views, respectively) a rotary steerable drilling apparatus (or "RSS tool") 100 in accordance with a first embodiment. RSS tool 100 comprises a cylindrical housing 10, which encloses a control assembly 50; and a drill bit 20. An annular space 12 is formed around control assembly 50 within housing 10, such that drilling fluid flowing into housing 10 will flow downward through annular space 12 toward drill bit 20. Drill bit 20 comprises a steering section 80 connected to the lower end of housing 10, and a cutting structure 90 connected to the lower end of steering section 80 so as to be rotatable therewith. Steering section 80 is preferably formed or provided with means for facilitating removal from housing 10, such as bit breaker slots 15. Cutting structure 90 may of any suitable type (for example, a polycrystalline diamond compact bit or a roller-cone-style bit), and cutting structure 90 does not form part of the broadest embodiments of apparatus in accordance with the present disclosure.

Steering section 80 has one or more fluid channels 30 extending downward from the upper end of steering section 80. As seen in FIG. 2, steering section 80 also has a central axial channel 22 for conveying drilling fluid to cutting structure 90, where the drilling fluid can exit under pressure through jets 24 (to enhance the effectiveness of cutting structure 90 as it drills into subsurface formation materials). Each fluid channel 30 leads to the radially inward end of a corresponding piston 40 extendable radially outward from steering section 80 in response to pressure from an actuating fluid flowing under pressure through fluid channel 30. Typically, each fluid channel 30 extends beyond its corresponding piston 40 to a terminal bit jet 34, which allows for fluid drainage and for bleeding off of fluid pressure.

Steering section 80 defines and incorporates a plurality of piston housings 28 protruding outward from steering section 80 (the main body of which will typically have a diameter matching or close to that of housing 10). The radial travel of each piston 40 is preferably restricted by any suitable means (indicated by way of example in FIG. 12 in the form of a transverse pin 41 passing through a slotted opening 43 in piston 40 and secured within piston housing 28 on each side of piston 40). This particular feature is by way of example only, and persons skilled in the art will appreciate that other means for restricting piston travel may be readily devised without departing from the scope of the present disclosure. Pistons 40 are also preferably provided with suitable biasing means (such as, by way of non-limiting example, biasing springs) biasing pistons 40 toward a retracted position within their respective piston housings 28.

In a typical case, the piston-actuating fluid will be a portion of the drilling fluid diverted from the fluid flowing through axial channel 22 to cutting structure 90. However, the piston-actuating fluid could alternatively be a fluid different from and/or from a different source than the drilling fluid flowing to cutting structure 90.

RSS tool 100 incorporates a fluid-metering assembly which in the embodiment shown in FIG. 2 comprises an upper sleeve 110 which is rotatable by means of control assembly 50 within and relative to a lower sleeve 120, which in turn is fixed to or integral with the upper end of steering section 80. As best seen in FIGS. 2A, 3A, 3B, and 3C, rotatable upper sleeve 110 has a bore 114 extending through a cylindrical section 116 extending downward below an annular upper flange 112. Cylindrical section 116 has a fluid-metering opening shown in the form of a vertical slot 118. As seen in FIGS. 2A, 4A, 4B, and 4C, fixed lower sleeve 120 has a bore 121 and a number of fluid inlets 122 geometrically arrayed to correspond with the fluid channels 30 in steering section 80. In the illustrated embodiments, fluid inlets 122 are arrayed in a circular pattern centered about the longitudinal centerline $CL_{RSS}$ of RSS tool 100.

Figure 2A:
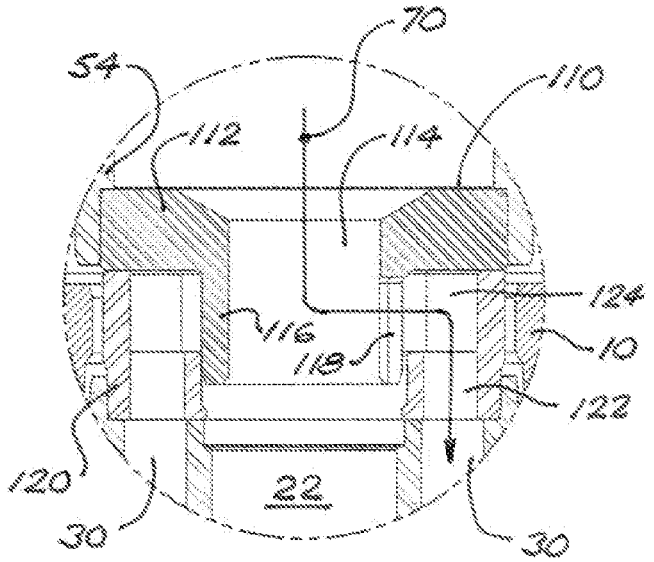
FIG. 2A is an enlarged detail of the fluid-metering assembly in FIG. 2.
Figure 3A:
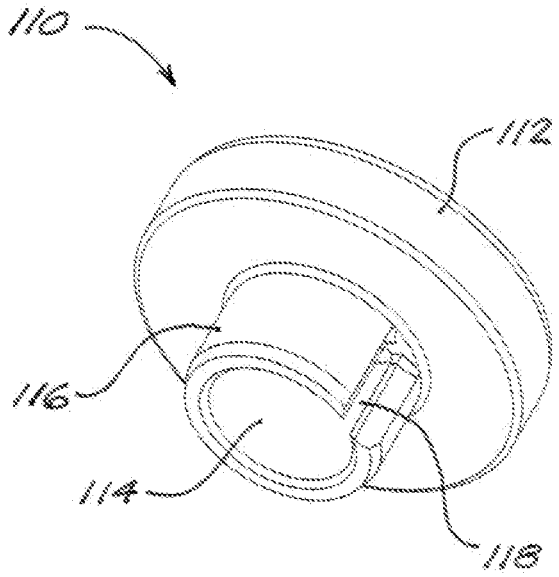
FIGS. 3A, 3B, and 3C are isometric, cross-sectional, and side views, respectively, of the rotating upper sleeve of the apparatus in FIG. 2.
Figure 3B:
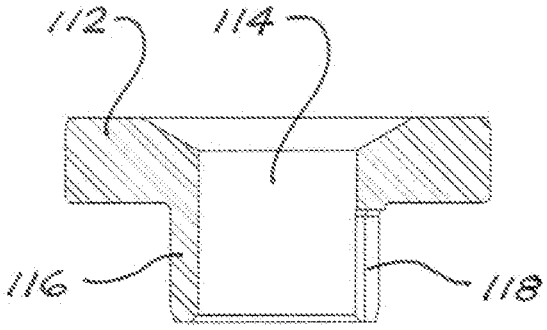
Figure 3C:
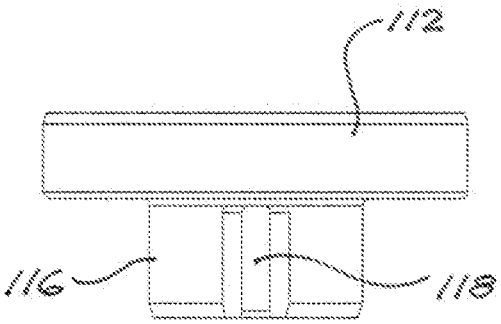
Figure 4A:
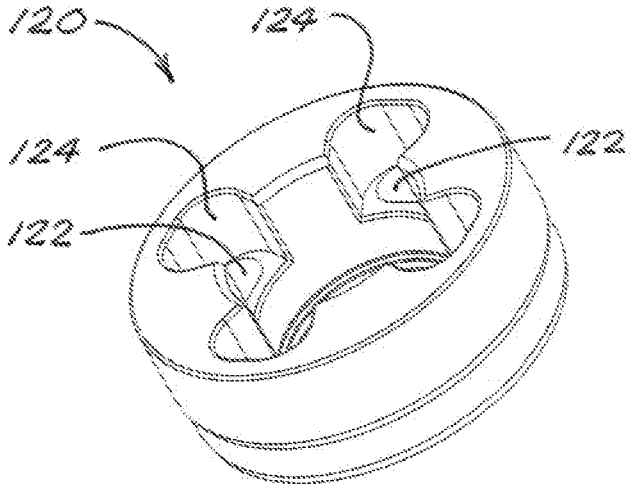
FIGS. 4A, 4B, and 4C are isometric, cross-sectional, and side views, respectively, of the fixed lower sleeve of the apparatus in FIG. 2.
Figure 4B:
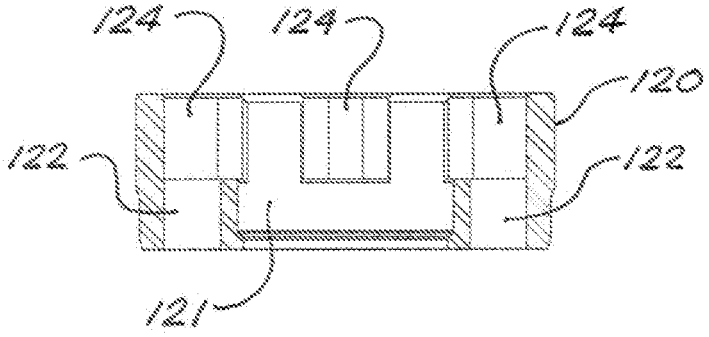
Figure 4C:
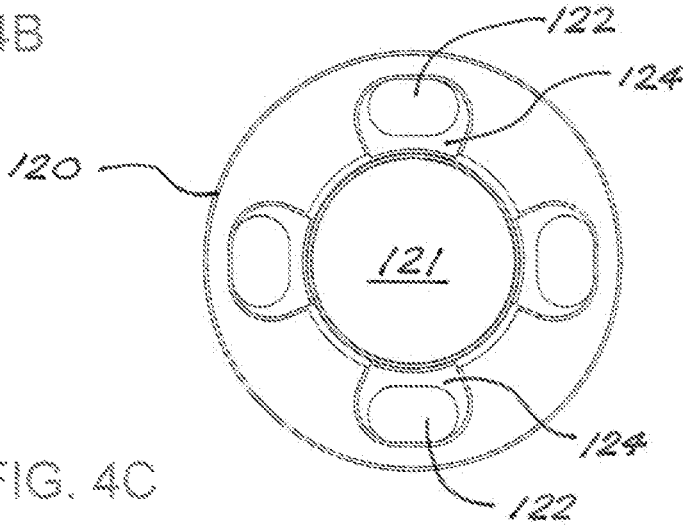
Figure 5:
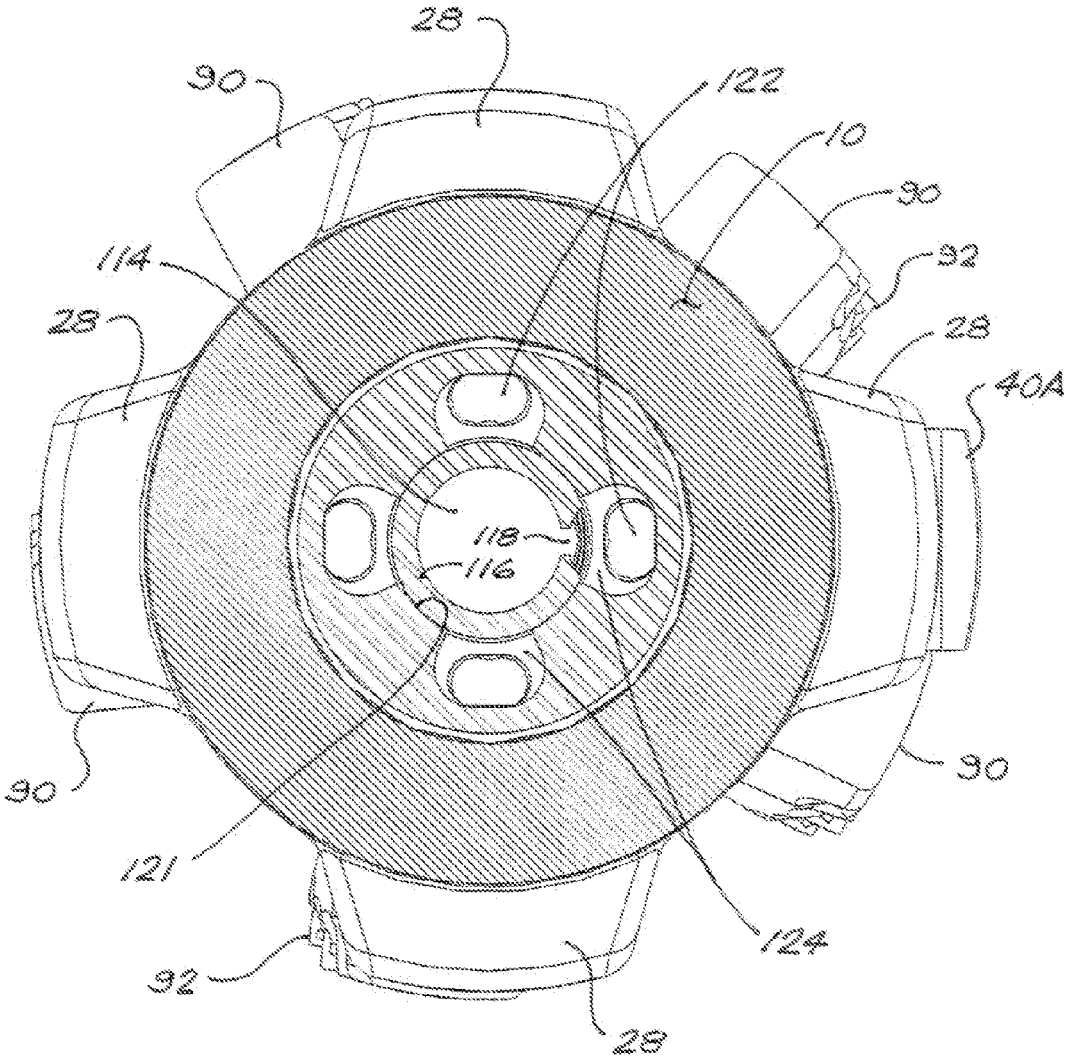
FIG. 5 is a transverse cross-section through the apparatus in FIG. 2, showing the fluid-metering slot in the rotating upper sleeve aligned with a fluid inlet in the fixed lower sleeve to permit fluid flow into the corresponding fluid channel in the drill bit, and showing the corresponding piston extended.
Figure 6:
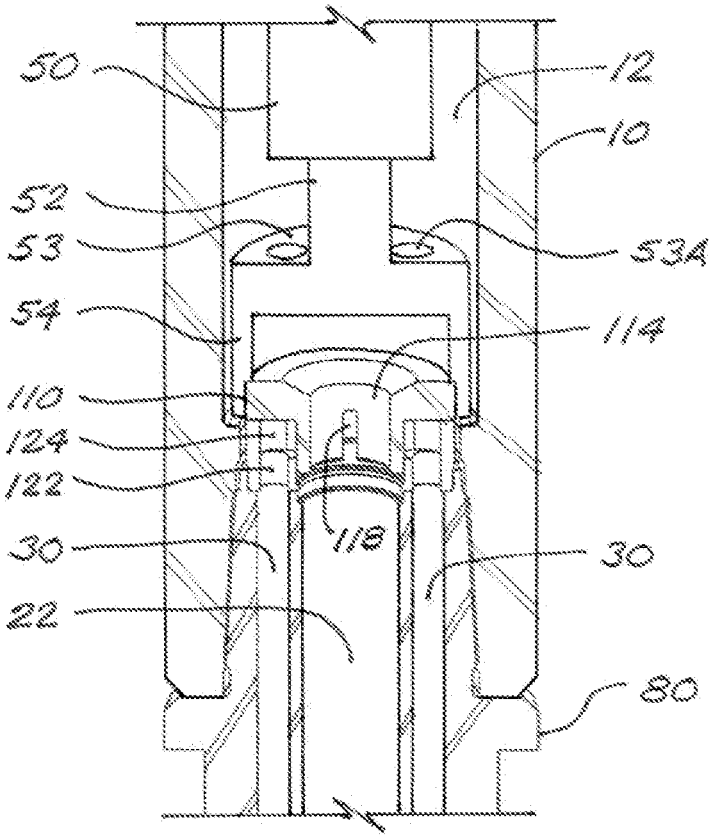
FIG. 6 is an isometric partial longitudinal section through a medial region of the apparatus in FIG. 2, showing the rotating upper sleeve, fixed lower sleeve with fluid inlets, and fluid channels in the steering section.

Recesses 124 are formed into an upper region of lower sleeve 120 to provide fluid communication between each fluid inlet 122 and bore 121. Accordingly, and as best seen in FIGS. 2A and 6, when cylindrical section 116 of upper sleeve 110 is disposed within bore 121 of lower sleeve 120, with fluid-metering slot 118 aligned with a given recess 124 in lower sleeve 120, bore 114 of upper sleeve 110 will be in fluid communication with the corresponding fluid channel 30 in steering section 80, via slot 118, recess 124, and fluid inlet 122. As may be seen in FIG. 5, the resultant flow of actuating fluid under pressure within the corresponding fluid channel 30 results in actuation and radially-outward extension of the corresponding piston (indicated in FIG. 5 by reference numeral 40A to denote an actuated piston).

The assembly and operation of the fluid-metering assembly described above can be further understood with reference to FIG. 6. Control assembly 50 is provided with metering assembly engagement means for rotating upper sleeve 110, and this could take any functionally effective form. By way of non-limiting example, the metering assembly engagement means is shown in FIGS. 2, 2A, and 6 as comprising a shaft 52 operably connected at its upper end to control assembly 50, and connected at its lower end to a cylindrical yoke 54 having an upper end plate 53 with one or more fluid openings 53A. Cylindrical yoke 54 is concentrically connected at its lower end 54L to flange 112 of upper sleeve 110, such that upper sleeve 110 will rotate relative to lower sleeve 120 when shaft 52 is rotated by control assembly 50. A fluid 70 flowing downward within the annular space 12 surrounding control assembly 50 within housing 10 flows through fluid openings 53A in upper end plate 53 of yoke 54, into the cylindrical cavity 55 within yoke 54, and then into bore 114 of upper sleeve 110. A portion of fluid 70 is diverted through slot 118 in cylindrical section 116 of upper sleeve 110 into the fluid inlet 120 aligned at the time with slot 118, and then into the corresponding fluid channel 30 to actuate the corresponding piston 40. The remainder of fluid 70 flows into main axial channel 22 in steering section 80 for delivery to cutting structure 90.

Figure 7:
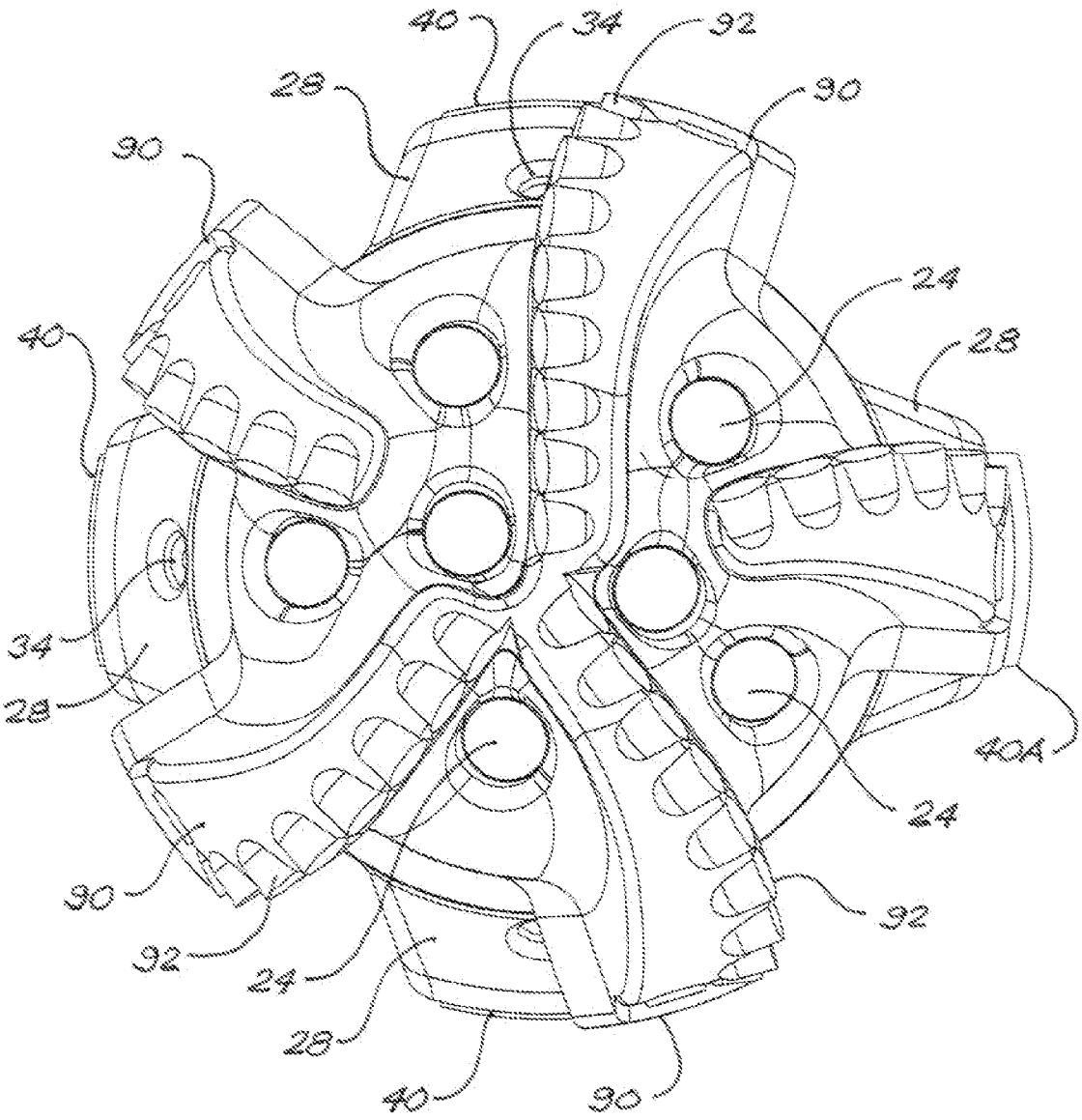
FIG. 7 is a bottom view of the apparatus of FIG. 2, showing the drill bit and piston housings, with one bit-deflecting piston extended.
Figure 13:
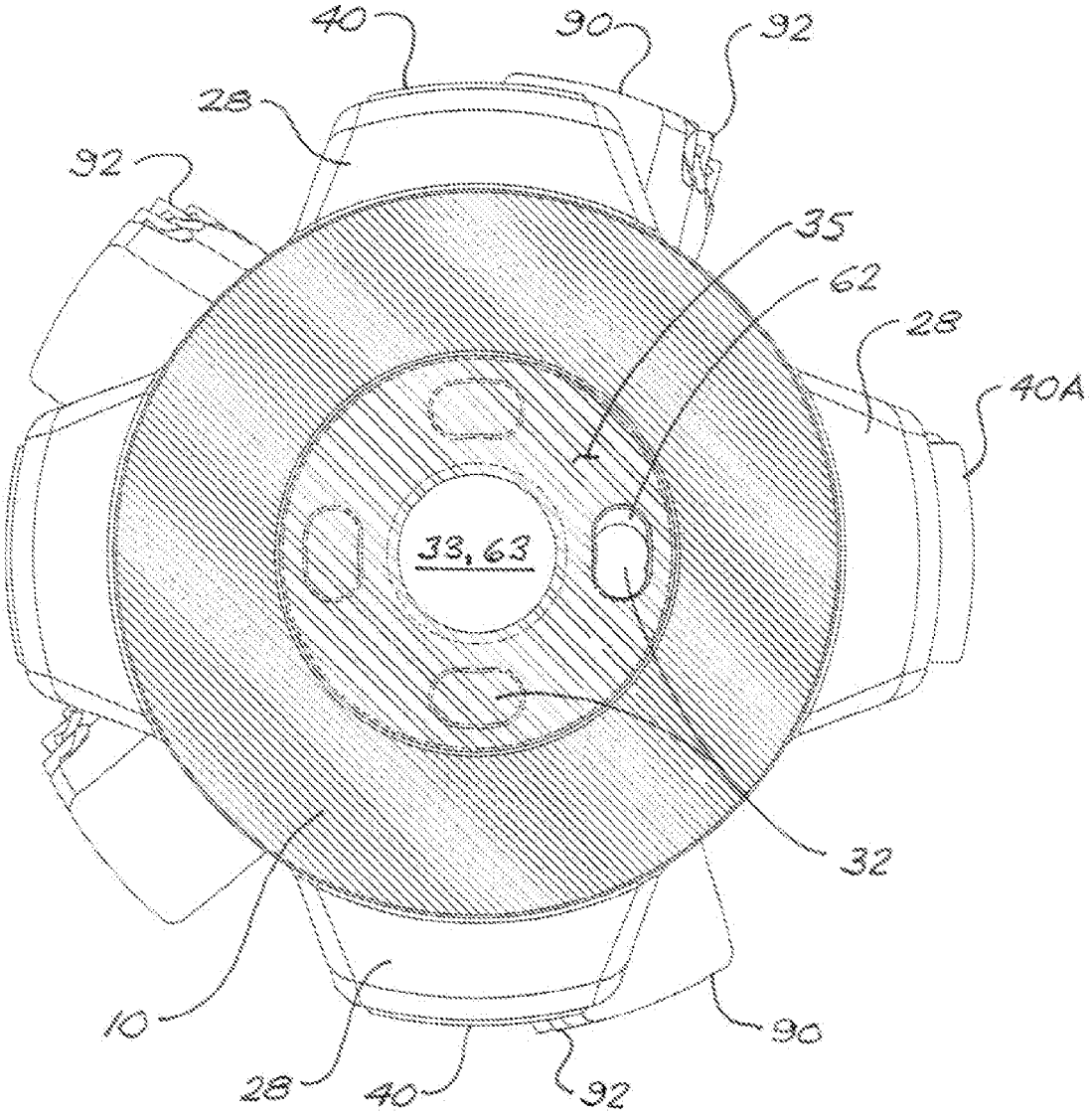
FIG. 13 is a transverse cross-section through the apparatus in FIG. 12, illustrating the fluid-metering opening in the rotating upper plate aligned with a fluid inlet through the fixed upper plate into the drill bit, and showing the corresponding bit-deflecting piston extended.

FIG. 7 is a bottom view of drill bit 20, showing cutting structure 90 with cutting elements or teeth 92, bit jets 24, pistons 40, and piston housings 28. In FIG. 13, one piston, marked 40A, is shown in its actuated position, extending radially outward from its piston housing 28.

Figure 8B:
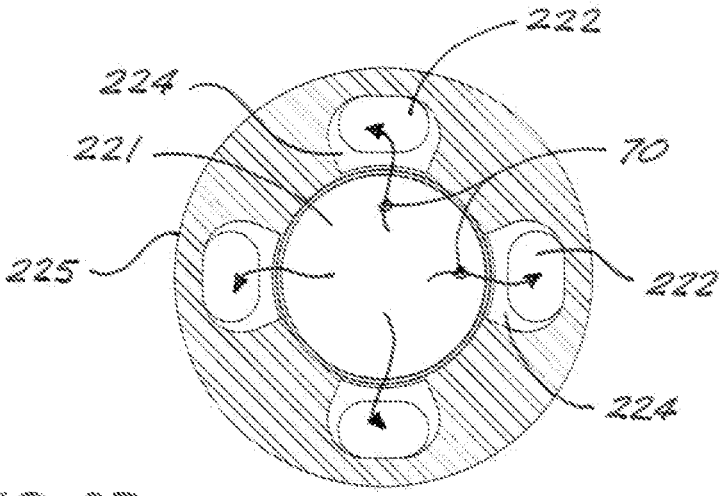
FIG. 8B is a transverse cross-section through the sleeve assembly in FIG. 8A, illustrating flow of piston-actuating fluid into all fluid inlets.
Figure 8A:
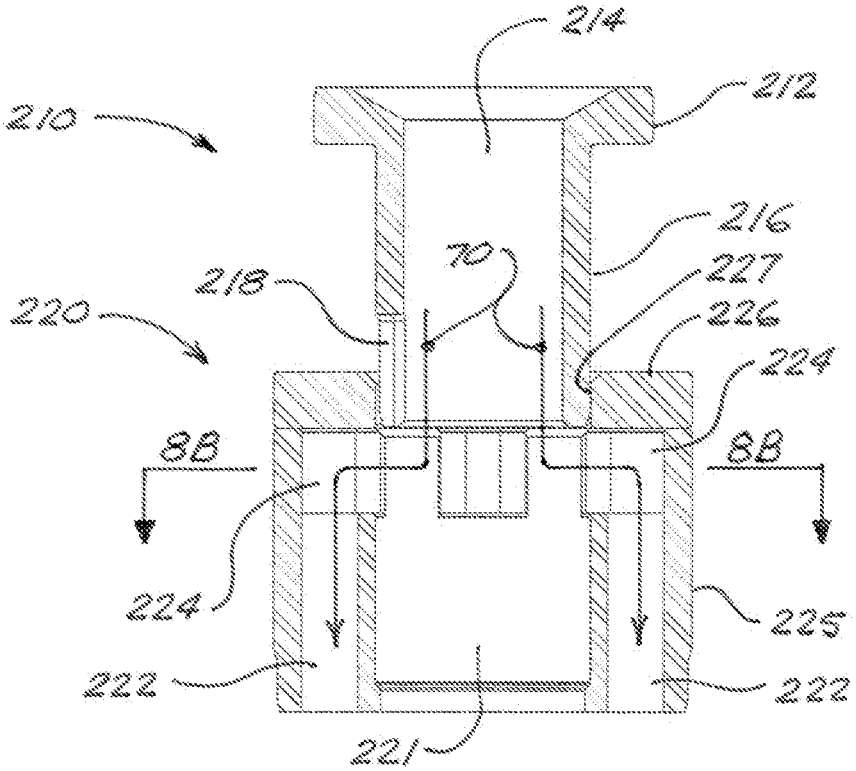
FIG. 8A is a cross-section through a variant of the sleeve assembly shown in FIGS. 2-6, with the rotating upper sleeve in an upper position in which piston-actuating fluid flows into all fluid channels.

FIG. 8A illustrates a variant of the sleeve assembly shown in FIGS. 2 and 6 and related detail drawings. Upper sleeve 210 in FIG. 8A is generally similar to upper sleeve 110 in FIGS. 3A-3C, with a flange 212 and a bore 214 similar to flange 112 and bore 114 in upper sleeve 110, except that it has a cylindrical section 216 longer than cylindrical section 116 in upper sleeve 110. Cylindrical section 216 has a fluid-metering slot 218 similar to fluid-metering slot 118 in cylindrical section 116, located in a lower region of cylindrical section 216. Lower sleeve 220 in FIG. 8A is generally similar to lower sleeve 120 in FIGS. 4A-4C, with fluid inlets 222 below corresponding recesses 224 (similar to fluid inlets 122 and recesses 24 in lower sleeve 120) formed into a lower body 225 having a bore 221 analogous to bore 121 in lower sleeve 120, plus a cap plate 226 extending across the top of lower body 25 and having a central opening for receiving cylindrical section 216 of upper sleeve 210.

As may be understood with reference to FIGS. 8A and 8B, when upper sleeve 210 is in an upper position relative to lower sleeve 220, with cylindrical section 216 raised at least partially clear of recesses 224 in lower sleeve 220, portions of fluid 70 flowing into bore 214 in upper sleeve 210 and bore 221 in lower sleeve 220 will be diverted directly into all recesses 224 and fluid inlets 222 to actuate all of pistons 40. In this operational mode, the actuated pistons will serve to centralize and stabilize drill bit 20 when drilling an undeviated section of a wellbore. This may be particularly beneficial and advantageous when drilling a straight but non-vertical section of the wellbore, and or when it is desirable to maximize the total flow area (TFA) at the bit (TFA being defined as the total area of all nozzles or jets through which fluid can flow out of the bit). TFA will be greatest when upper sleeve 210 is in its uppermost position, in which fluid can flow into all fluid channels 30. This is because fluid will be able to flow out of all terminal bit jets 34 connecting to fluid channels 30, in addition to flowing out of all bit jets 24 in cutting structure 90. In contrast, TFA will be least when upper sleeve 210 is in its lowermost position (as shown in FIGS. 10A and 10B), in which fluid flow into all fluid channels 30 is blocked, and fluid can exit the tool only through bit jets 24.

Drill bit stabilization with all pistons extended may also be desirable during "straight" drilling to mitigate "bit whirl" which can result in poor wellbore quality when drilling through soft formations.

Figure 9B:
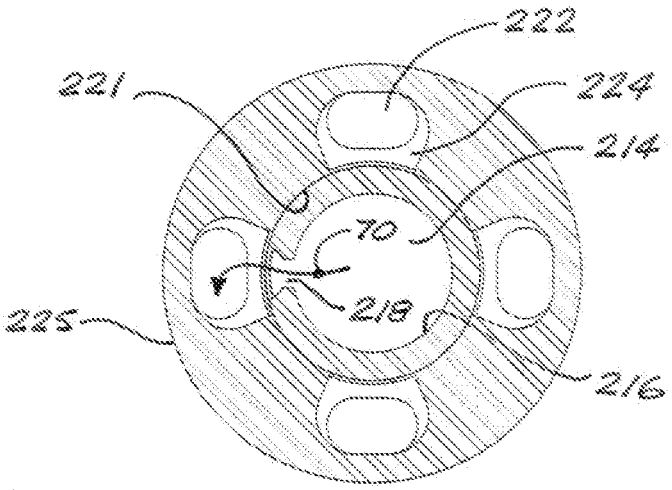
FIG. 9B is a transverse cross-section through the sleeve assembly in FIG. 9A, illustrating flow of piston-actuating fluid into the fluid inlet aligned with the slot in the rotating upper sleeve.
Figure 9A:
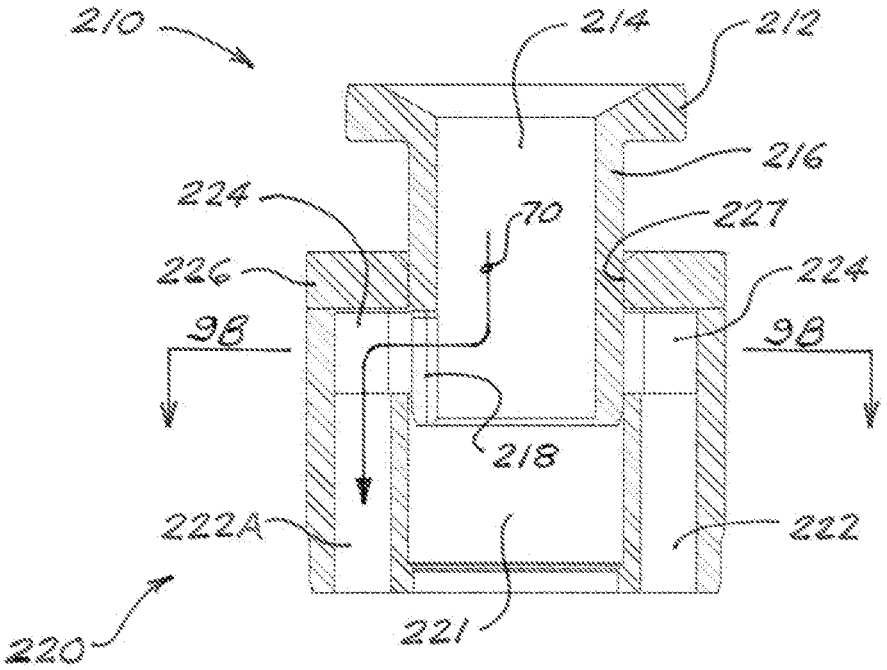
FIG. 9A is a cross-section through the variant sleeve assembly in FIG. 8A, with the rotating upper sleeve in an intermediate position in which piston-actuating fluid flows only into one fluid inlet.

FIGS. 9A and 9B illustrate the situation when upper sleeve 210 is in an intermediate position relative to lower sleeve 220, with cylindrical section 216 extending below cap plate 226 to permit fluid flow from bore 214 through fluid-metering slot 218. In this operational mode, fluid 70 will be diverted into a recess 224 aligned with slot 218, and then into the corresponding fluid inlet 222 to actuate the corresponding piston 40; i.e., essentially the same as for the sleeve assembly shown in FIG. 2A.

Figure 10B:
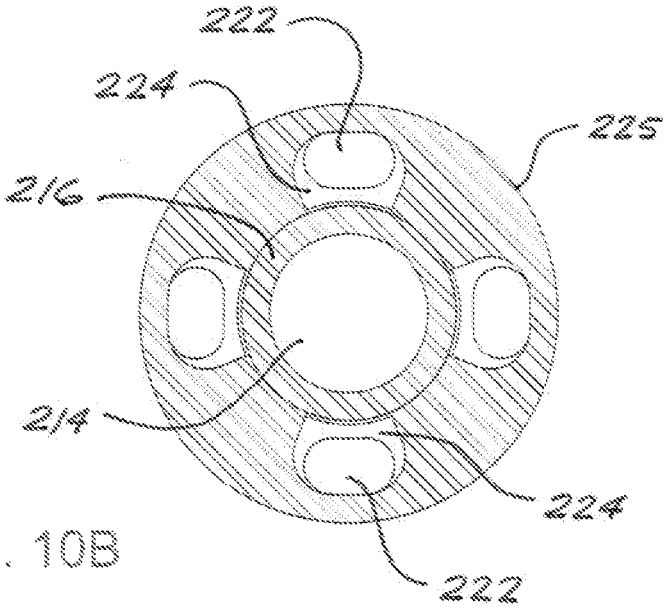
FIG. 10B is a transverse cross-section through the sleeve assembly in FIG. 10A, illustrating fluid flow to the fluid inlets blocked.
Figure 10A:
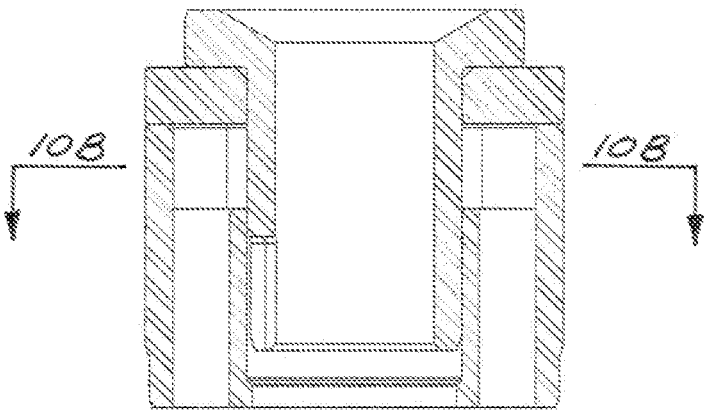
FIG. 10A is a cross-section through the variant sleeve assembly in FIG. 8A, with the rotating upper sleeve in a lower position in which actuating fluid cannot flow into any of the fluid inlets.

FIGS. 10A and 10B illustrate the situation when upper sleeve 210 is in a lower position relative to lower sleeve 220, with slot 218 disposed below recesses 224 such that fluid cannot enter any of recesses 224 and fluid inlets 222. In this operational mode, all of fluid 70 will flow directly to cutting structure 90, without diversion. This may be desirable for straight drilling through comparatively stable subsoil materials, with a smaller TFA at the bit.

To operate a fluid-metering assembly incorporating upper and lower sleeves 210 and 220 as in FIGS. 8A-10B, control assembly 50 will incorporate or be provided with means for raising and lowering upper sleeve 210 in addition to rotating upper sleeve 210. Persons skilled in the art will appreciate that various means for axially moving upper sleeve 210 relative to lower sleeve 220 can be devised in accordance with known technologies, and the present disclosure is not limited to the use of any particular such means.

Figure 11:
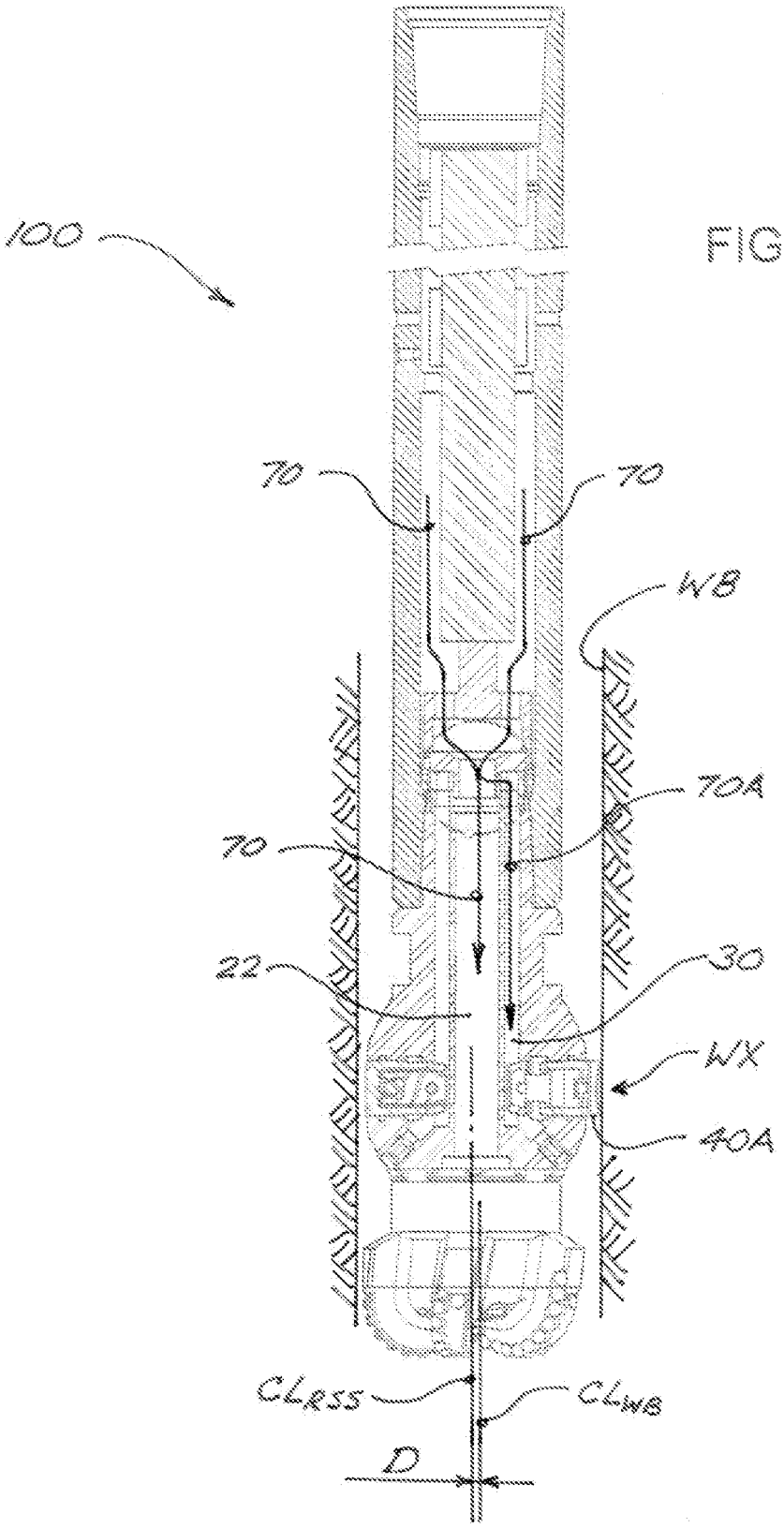
FIG. 11 is a longitudinal cross-section similar to FIG. 2, showing the rotary drilling apparatus in operation within a wellbore, with one piston radially extended and exerting a bit-deflecting force against one side of the wellbore.

FIG. 11 illustrates RSS tool 100 as in FIG. 2, in operation within a wellbore WB. In this view, a portion 70A of fluid 70 from annular space 12 of RSS 100 has been diverted into an "active" fluid channel 30A in steering section 80 via fluid-metering slot 118 in rotating upper sleeve 110 of the fluid-metering assembly. The flow of fluid under pressure into fluid channel 30A actuates the corresponding piston 40A, causing actuated piston 40A to extend radially outward from steering section 80 and into reacting contact with the wall of wellbore WB in a contact region WX, thus exerting a transverse force against steering section 80 deflecting cutting structure 90 in the direction away from contact region WX by a deflection D, being the lateral offset of the deflected axial centerline $CL_{RSS}$ of RSS tool 100 relative to the centerline $CL_{WB}$ of wellbore WB. Contact region WX, for a given fixed orientation of upper sleeve 110 and its fluid-metering slot 118 relative to wellbore WB, will not be a specific fixed point or region on the wellbore wall, but rather will move as drilling progresses deeper into the ground. However, for in operational modes providing for actuation of only one piston 40 at a given time, contact region WX will always correspond to the angular position of fluid-metering slot 118.

As tool 100 continues rotating, the flow of actuating fluid 70A into active fluid channel 30A will be blocked off, thus relieving the hydraulic force actuating piston 40A which will then be retracted into the body of steering section 80. Further rotation of tool 100 will cause actuating fluid to flow into the next fluid channel 30 in steering section 80, thereby actuating and extending the next piston 40 in sequence, and exerting another transverse force in contact region WX of wellbore WB.

Accordingly, for each rotation of tool 100, a bit-deflecting transverse force will be exerted against wellbore WB, in contact region WX, the same number of times as the number of fluid channels 30 in steering section 80, thus maintaining an effectively constant deflection D of cutting structure 90 in a constant transverse direction relative to wellbore WB. As a result of this deflection, the angular orientation of wellbore WB will gradually change, creating a curved section in wellbore WB.

When a desired degree of wellbore curvature or deviation has been achieved, and it is desired to drill an undeviated section of wellbore, the operation of control assembly 50 is adjusted to rotate upper sleeve 110 such that fluid-metering slot 118 is in a neutral position between an adjacent pair of recesses 124 in lower sleeve 120, such that fluid 70 cannot be diverted into any of the fluid inlets 122 in lower sleeve 120. Control assembly 50 (or an associated metering assembly engagement means) then is either disengaged from upper sleeve 110, leaving upper sleeve 110 free to rotate with lower sleeve 120 and steering section 80, or alternatively is actuated to rotate at the same rate as tool 100, thereby in either case maintaining slot 118 in a neutral position relative to lower sleeve 120 such that fluid cannot flow to any of pistons 40. Drilling operations may then be continued without any transverse force acting to deflect cutting structure 90.

In variant embodiments in which the fluid-metering assembly includes axially-movable upper sleeve 210 and lower sleeve 220 as shown in FIGS. 8A-10B, the transition to non-deviated drilling operations is effected by moving upper sleeve 210 (by means of control assembly 50) to either its upper or lower position relative to lower sleeve 220, as may be desired or appropriate having regard to operational considerations. Fluid flow to fluid channels 30 will then be prevented regardless of whether upper sleeve 210 continues to rotate relative to lower sleeve 220.

Figure 12:
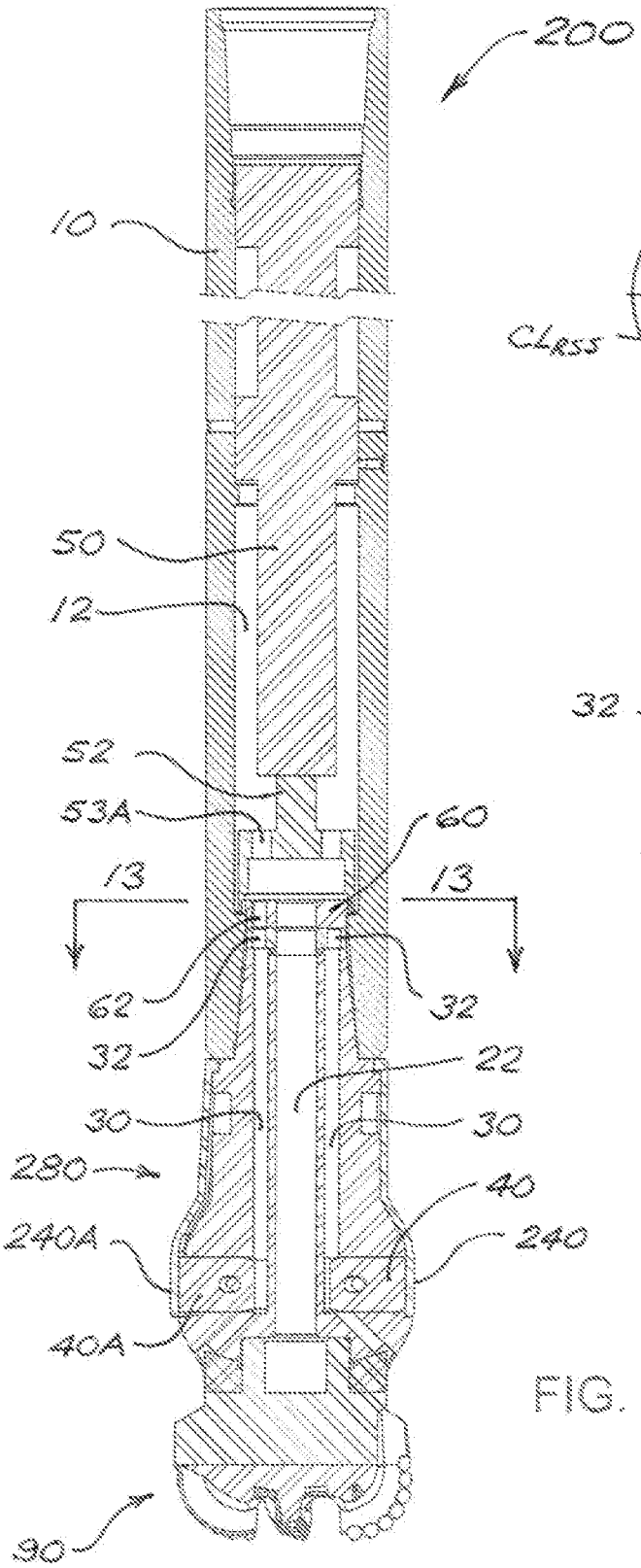
FIG. 12 is a longitudinal cross-section through a second embodiment of the rotary drilling apparatus in FIG. 1, with a resiliently-mounted reaction member associated with each piston, and in which the fluid-metering assembly comprises a rotating upper plate and a fixed lower plate.
Figure 12A:
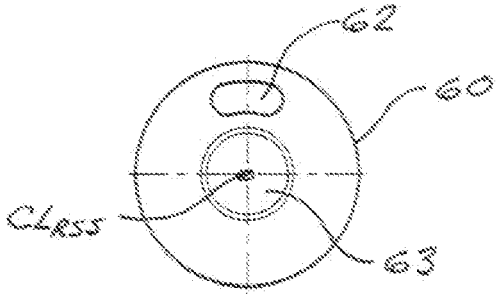
FIG. 12A is a plan view of the rotating upper plate of the fluid-metering assembly in FIG. 12.
Figure 12B:
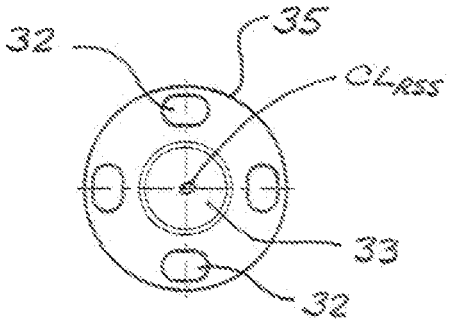
FIG. 12B is a plan view of the fixed lower plate of the fluid-metering assembly in FIG. 12.

FIG. 12 illustrates an RSS tool 200 in accordance with an alternative embodiment in which the fluid-metering assembly comprises a rotating upper plate 60 and a lower plate 35 fixed to or formed integrally into the upper end of a modified steering section 280. Lower plate 35 has one or more fluid inlets 32 analogous to fluid inlets 122 in lower sleeve 120 shown in FIGS. 2 and 6 (and elsewhere herein). In the illustrated embodiment, and as shown in FIG. 12B, fluid inlets 32 are arrayed in a circular pattern about centerline $CL_{RSS}$ of RSS tool 200. Upper plate 60 is rotatable, relative to housing 10, about a rotational axis coincident with centerline $CL_{RSS}$. As shown in FIG. 12A, upper plate 60 has a fluid-metering hole 62 offset from centerline $CL_{RSS}$ at a radius corresponding to the radius of the circle of the fluid inlets 32 formed in fixed lower plate 35. Upper plate 60 also has a central opening 63 to permit fluid flow downward into axial channel 22 of steering section 80, and lower plate 35 has a central opening 33 for the same purpose.

The fluid-metering assembly shown in FIGS. 12, 12A, and 12B functions in essentially the same way as previously described with respect to RSS tool embodiments having a fluid-metering assembly incorporating an upper sleeve 110 (or 210) and a lower sleeve 120 (or 220). Upper plate 60 is rotated by control assembly 50 (such as by means of a yoke 54 as previously described) so as to keep fluid-metering hole 62 in a fixed orientation relative to wellbore WB irrespective of the rotation of housing 10 and steering section 80. As housing 10 and steering section 80 rotate relative to wellbore WB, fluid-metering hole 62 in upper plate 60 will come into alignment with each of the fluid inlets 32 in lower plate 35 in sequence, thus allowing a portion of the fluid flowing from annular space 12 through fluid openings 53A in upper end plate 53 of yoke 54 to be diverted into each fluid channel 30 in sequence, and causing the corresponding pistons 40 to be radially extended in sequence, thus inducing a deviation in the orientation of wellbore WB as previously described.

FIG. 13 is a cross-section through housing 10 just above rotating upper plate 60, showing offset hole 62 in upper plate 60 and, in broken outline, fluid inlets 32 (four in total in the illustrated embodiment) in fixed lower plate 35 disposed below upper plate 60. As well, FIG. 13 illustrates pistons 40 and their corresponding piston housings 28 (four in total, corresponding to the number of fluid inlets 32) and, therebelow, cutting structure 90 with drill bit teeth 92. FIG. 13 illustrates the alignment of fluid-metering hole 62 of upper plate 60 with one of the fluid inlets 32 in lower plate 35, resulting in radially-outward extension of a corresponding actuated piston 40A.

To transition RSS tool 200 to undeviated drilling operations, control assembly 50 is actuated to rotate upper plate 60 to a neutral position relative to lower plate such that fluid-metering hole 62 is not in alignment with any of the fluid inlets 32 in lower plate 35, and upper plate 60 is then rotated at the same rate as steering section 80 to keep fluid-metering hole 62 in the neutral position relative to lower plate 35.

In an alternative embodiment of the apparatus (not shown), upper plate 60 can be selectively moved axially and upward away from lower plate 35, thus allowing fluid flow into all fluid channels 30 and causing outward extension of all pistons 40. This results in equal transverse forces being exerted all around the perimeter of steering section 80 and effectively causing cutting structure 90 to drill straight, without deviation, while also stabilizing cutting structure 90 within wellbore WB, similar to the case for previously-described embodiments incorporating upper and lower sleeves 210 and 220 when upper sleeve 210 is in its upper position relative to lower sleeve 220. Control system 50 can be deactivated or put into hibernation mode when upper plate 60 and lower plate 35 are not in contact, thus saving battery life and wear on the control system components.

In one embodiment, control assembly 50 comprises an electronically-controlled positive displacement (PD) motor that rotates upper plate 60 (or upper sleeve 110 or 210), but control assembly 50 is not limited to this or any other particular type of mechanism.

Steerable rotary drilling systems in accordance with the present disclosure can be readily adapted to facilitate change-out of the highly-cycled pistons during bit changes. This ability to change out the pistons independently of the control system, in a design that provides a field-changeable interface, makes the system more compact, easier to service, more versatile, and more reliable than conventional steerable systems. RSS tools in accordance with the present disclosure will also allow multiple different sizes and types of drill bits and/or pistons to be used in conjunction with the same control system without having to change out anything other than the steering system and/or cutting structure. This means, for example, that the system can be used to drill a 12-¼" (311 mm) wellbore, and subsequently be used to drill a 8-¾" (222 mm) wellbore, without changing the control system housing size, thus saving time and requiring less equipment.

The system can also be adapted to allow use of the drill bit separately from the control system. Optionally, the control assembly can be of modular design to control not only drill bits but also other drilling tools that can make beneficial use of the rotating upper plate (or sleeve) of the tool to perform useful tasks.

FIGS. 14A, 14B, 14C, and 14D illustrate the steering section 280 of an RSS tool in accordance with the embodiment shown in FIG. 12. Steering section 280 is substantially similar to steering section 80 described with reference to FIG. 12, and like reference numbers are used for components common to both embodiments. Steering section 280 is shown by way of non-limiting example with an upper pin end 16 for purposes of threaded connection to the lower end of housing 10, and with a lower box end 17 for threaded connection to the upper end of cutting structure 90. Steering section 280 is distinguished from steering section 80 shown in FIG. 2 by the provision of flexible reaction pads 240, each of which has an upper end resiliently mounted to the main body of steering section 280 and a free lower end 241 which extends over a corresponding piston housing 28. In the illustrated embodiment, the resilient mounting of flexible reaction pads 240 to the body of steering section 280 is accomplished by having the upper ends of reaction pads 240 formed integrally with a circular band 242 disposed within an annular groove 243 extending around the circumference of steering section 280 at a point below pin end 16. However, this is by way of example only. Persons skilled in the art will appreciate that other ways of resiliently mounting the upper ends of reaction pads 240 to steering section 280 may be readily devised, and the present disclosure is not limited to the use of any particular means or method of mounting reaction pads 240.

Figure 14C:
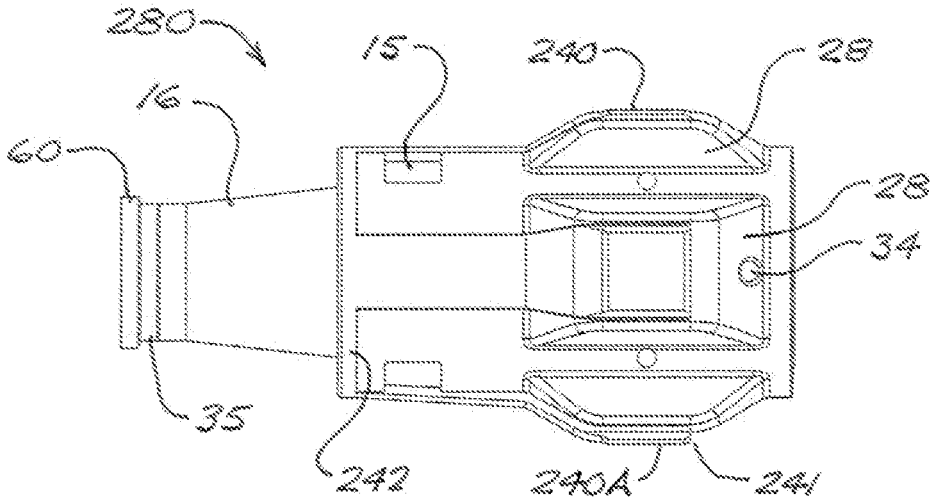
FIG. 14C is a side view of the apparatus in FIG. 14A, with one piston actuated and deflecting its associated flexible reaction member.
Figure 14D:
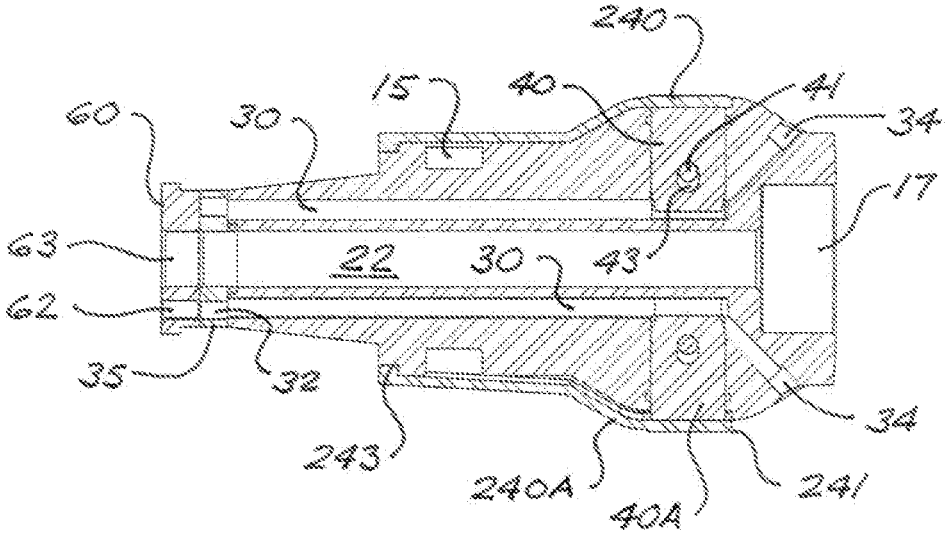
FIG. 14D is a longitudinal cross-section through the apparatus in FIG. 14A, with one piston actuated and deflecting its associated flexible reaction member.

As best appreciated with reference to the upper portion of FIG. 14D, when a given piston 40 is in its retracted position, the free lower end 241 of its associated flexible reaction pad 240 will preferably lie flush or nearly so with the outer surface of the associated piston housing 28. However, when a piston is actuated (as illustrated by actuated piston 40A in the lower portion of FIG. 14D), it will deflect the free lower end 241 of the associated reaction pad (indicated by reference number 240A in FIG. 14D) radially outward. The deflected flexible reaction pad 240A will thus be pushed toward and against the wall of the wellbore, resulting in steering section 280 and cutting structure 90 being pushed in the radially opposite direction. When actuated piston 40A retracts into its piston housing 28, the free lower end of reaction pad 240A will elastically rebound to its unstressed state and position.

FIGS. 15A, 15B, 15C, and 15D illustrate the steering section 380 of an RSS tool in accordance with an alternative embodiment. Steering section 380 is substantially similar to steering section 80 described with reference to FIG. 12, and like reference numbers are used for components common to both embodiments. Steering section 380 is distinguished from steering section 80 by the provision of hinged reaction pads 340, each of which extends over a corresponding piston housing 28, to which reaction pad 340 is mounted at one or more hinge points 342 so as to be pivotable about a hinge axis substantially parallel to the longitudinal axis of steering section 380. Hinge points 342 are preferably located on the leading edges of hinged reaction pads 340 (the term "leading edge" being relative to the direction of rotation of the tool).

Figure 15C:
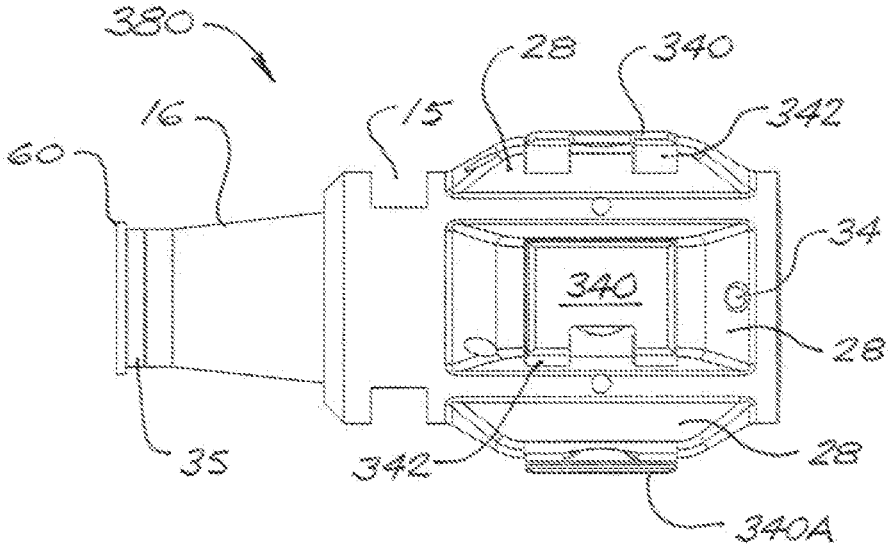
FIG. 15C is a side view of the apparatus in FIG. 15A, with one piston actuated and deflecting its associated hinged reaction member.
Figure 15D:
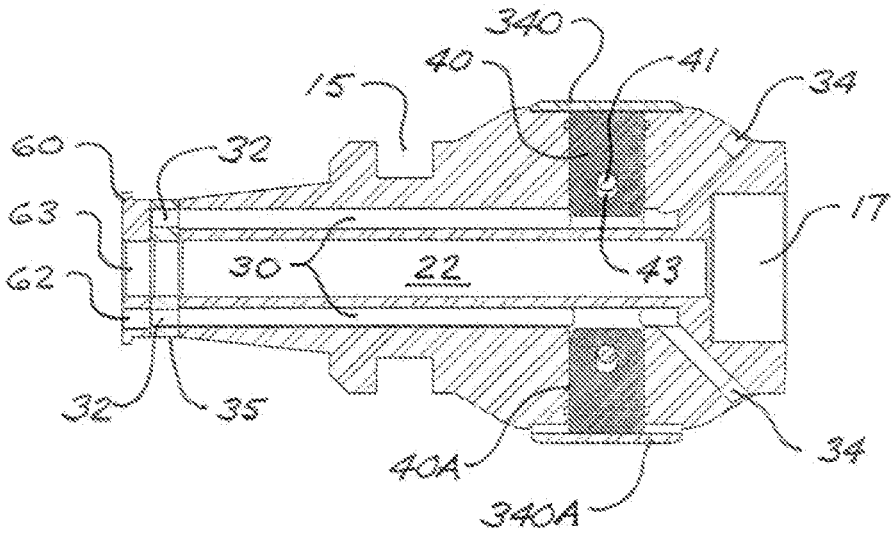
FIG. 15D is a longitudinal cross-section through the apparatus in FIG. 15A, with one piston actuated and deflecting its associated hinged reaction member.
Figure 16A:
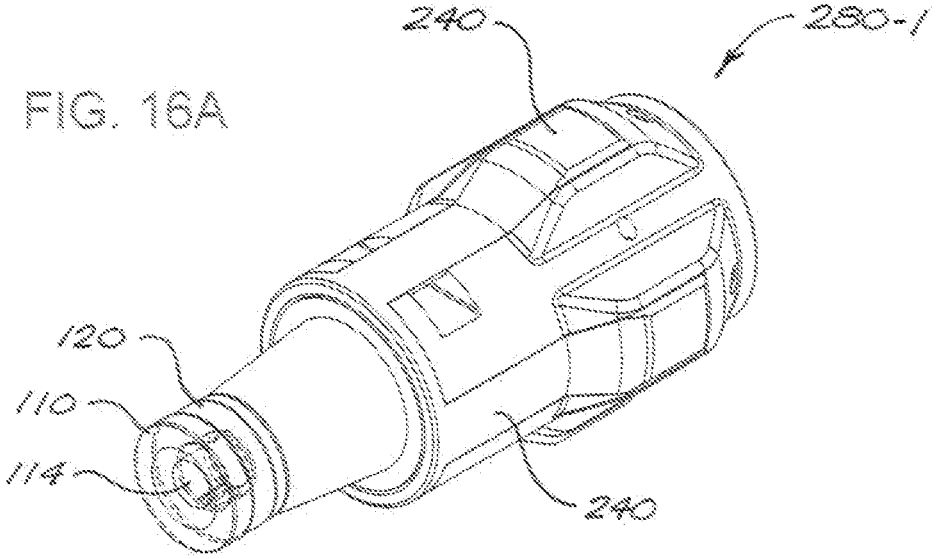
FIG. 16A is an isometric view of a variant of the steering section of the apparatus in FIG. 12, with the fluid-metering assembly incorporating a sleeve assembly as in FIGS. 2-6.
Figure 16B:
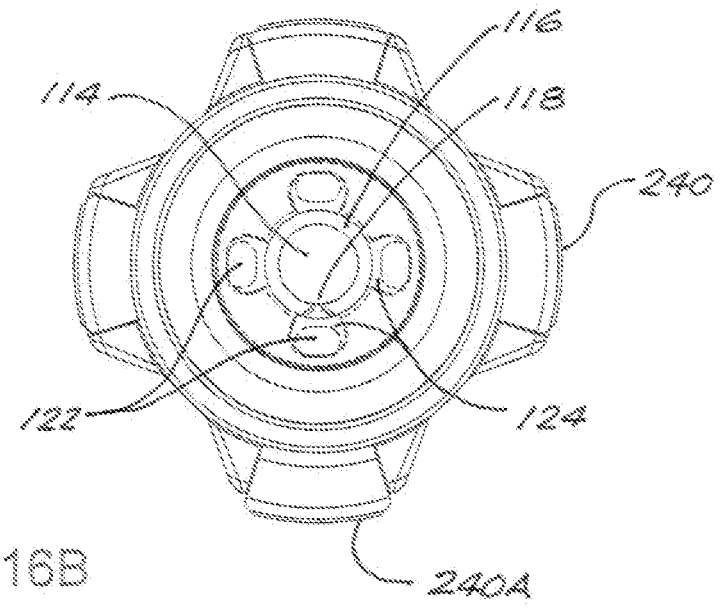
FIG. 16B is a top end view of the apparatus in FIG. 16A, showing the upper and lower sleeves of the piston-actuating mechanism, the piston housings, and the resiliently-mounted flexible reaction members.
Figure 16C:
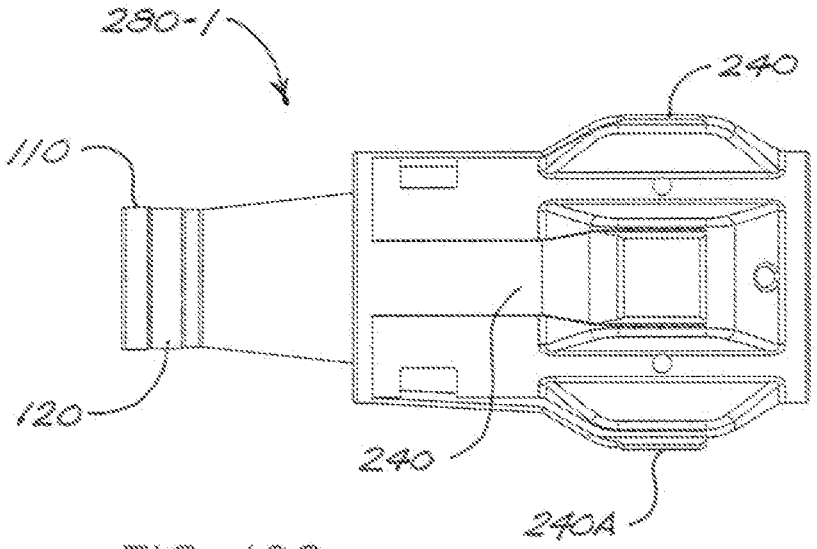
FIG. 16C is a side view of the apparatus in FIG. 16A, with one piston actuated and deflecting its associated flexible reaction member.
Figure 16D:
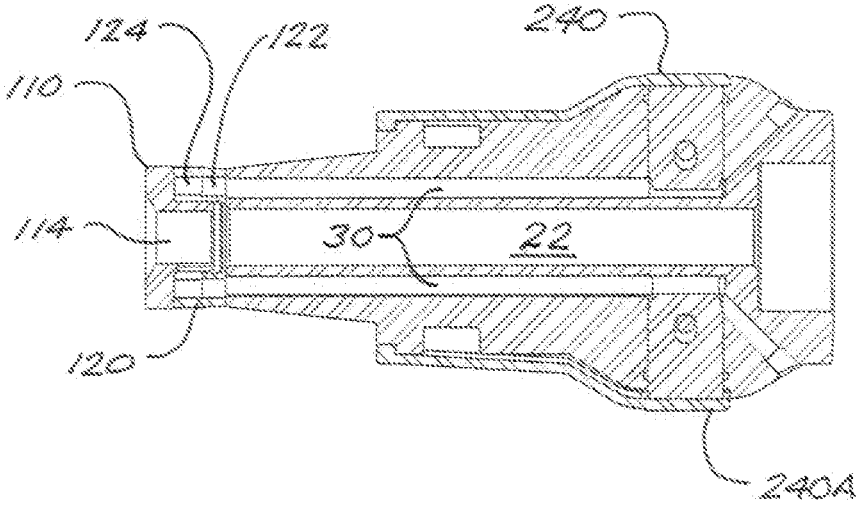
FIG. 16D is a longitudinal cross-section through the apparatus in FIG. 16A, with one piston actuated and deflecting its associated flexible reaction member.

As best appreciated with reference to the upper portion of FIG. 15D, when a given piston 40 is in its retracted position, its associated hinged reaction pad 340 will preferably lie flush or nearly so with the surface of the associated piston housing 28. However, when a piston is actuated (as illustrated by actuated piston 40A in the lower portion of FIG. 15D), it will push outward against its corresponding hinged reaction pad 340A, causing pad 340A to pivot about its hinge point(s) 342 and deflect outward toward and against the wall of the wellbore, as seen in FIGS. 15C and 15D. This results in steering section 380 and cutting structure 90 being pushed in the radially opposite direction. When actuated piston 40A retracts into its piston housing 28, the deflected hinged reaction pad 340A can be returned to its original position, assisted as appropriate by suitable biasing means.

FIGS. 16A, 16B, 16C, and 16D illustrate a variant 280-1 of steering section 280 shown in FIGS. 14A, 14B, 14C, and 14D, with the only difference being that the fluid-metering assembly in steering section 280-1 incorporates upper and lower sleeves 110 and 120 as in FIGS. 3A-3C and 4A-4C, rather than upper and lower plates 60 and 35 as in steering section 280. Components and features not having reference numbers in FIGS. 16A, 16B, 16C, and 16D correspond to like components and features shown and referenced in FIGS. 14A, 14B, 14C, and 14D. Persons skilled in the art will also appreciate that steering section 380 shown in FIGS. 15A, 15B, 15C, and 15D could be similarly adapted.

RSS tools in accordance with the present disclosure may use pistons of any functionally suitable type and construction, and the disclosure is not limited to the use of any particular type of piston described or illustrated herein. FIGS. 12, 14D, 15D, and 16D, for instance, show unitary or one-piece pistons 40. FIGS. 17A to 21 illustrate an embodiment of an alternative piston assembly 140 comprising an outer (or upper) member 150, an inner (or lower) member 160, and, in preferred embodiments, a biasing spring 170. In this description of piston assembly 140 and its constituent elements, the adjectives "inner" and "outer" are used relative to the centerline of a steering section 80 in conjunction with which piston 140 is installed; i.e., inner member 160 will be disposed radially inward of outer member 150, while outer member 150 is extendable radially outward from steering section 80 (and away from inner member 160). However, for convenience in describing these components, the adjectives "upper" and "lower" may be used interchangeably with "outer" and "inner", respectively, in correspondence with the graphical representation of these elements in FIGS. 17A to 21.

Figure 17A:
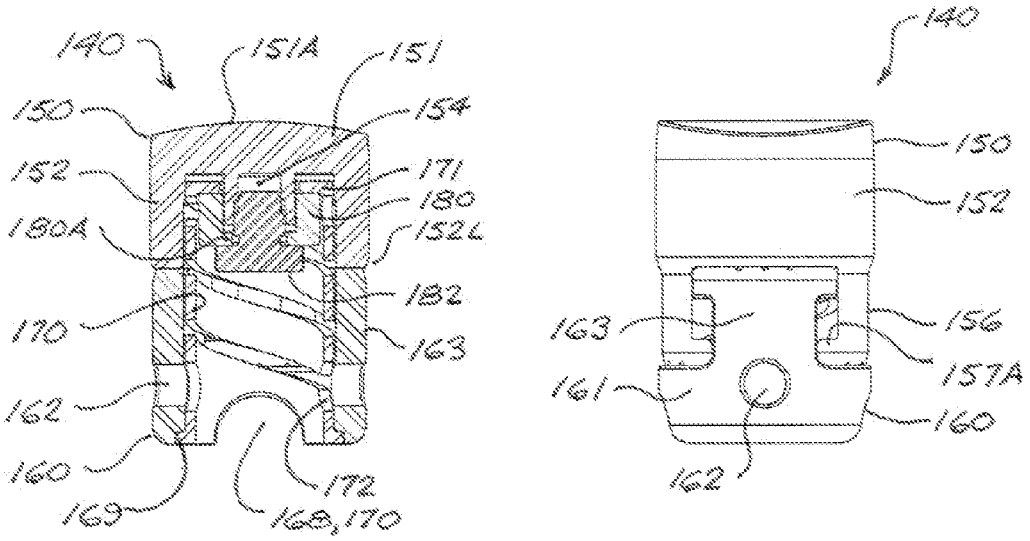
FIG. 17A is a cross-section through one embodiment of a piston assembly in accordance with the present disclosure, shown in a retracted position.
Figure 17B:
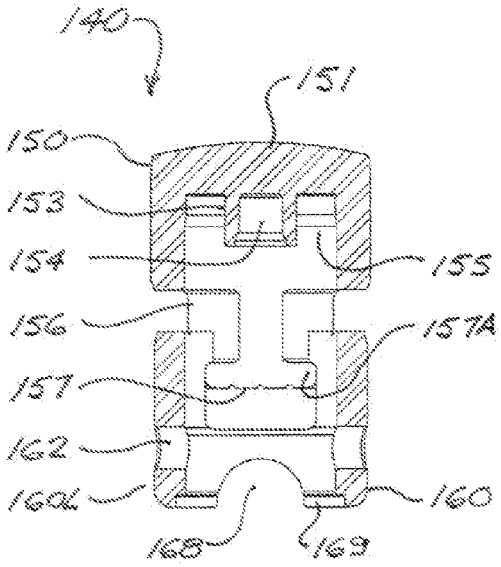
FIG. 17B is a cross-section through the piston assembly in FIG. 17A, shown in an extended position (and with the biasing spring not shown for clarity of illustration).

As shown in particular detail in FIGS. 17A and 17B, outer member 150 of piston assembly 140 has a cylindrical sidewall 152 with an upper end 152U closed off by a cap member 151, and an open lower end 152L. The upper (or outer) surface 151A of cap member 151 may optionally be contoured as shown in FIGS. 17A, 17B, 18A, and 18B to conform with the effective diameter of a cutting structure 90 mounted to steering section 80, in embodiments intended for direct piston contact with a wellbore wall, without intervening reaction members. The embodiment of outer member 150 shown in FIGS. 17A and 17B is adapted to receive the upper end of biasing spring 170 (in a manner to be described later herein), and for that purpose is formed with a cylindrical boss 153 projecting coaxially downward from cap member 151 and having an open-bottomed and internally-threaded cavity 154. An open-bottomed annular space 155 is thus formed between boss 153 and sidewall 152 of outer member 150.

Extending downward from cylindrical sidewall 152 are a pair of spaced, curvilinear, and diametrically-opposed sidewall extensions 156, each having a lower portion 157 formed with a circumferentially-projecting lug or stop element 157A at each circumferential end of lower portion 157. Each sidewall extension 156 can thus be described as taking the general shape of an inverted "T", with a pair of diametrically-opposed sidewall openings 156A being formed between the two sidewall extensions 156.

Inner member 160 of piston assembly 140 has a cylindrical sidewall 161 having an upper end 160U and a lower end 160L, and enclosing a cylindrical cavity 165 which is open at each end. A pair of diametrically-opposed retainer pin openings 162 are formed through sidewall 161 for receiving a retainer pin 145 for securing inner member 160 to and within steering section 80, such that the position of inner member 160 relative to steering section 80 will be radially fixed. A pair of diametrically-opposed fluid openings 168 (semi-circular or semi-ovate in the illustrated embodiment) are formed into sidewall 161 of inner member 160, intercepting lower end 160L of inner member 160 and at right angles to retainer pin openings 162, so as to be generally aligned with corresponding fluid channels 30 when piston 40 is installed in steering section 80, to permit passage of drilling fluid downward beyond inner member 160 and into a corresponding bit jet 34 in steering section 80. As best seen in FIG. 17B, and for purposes to be described later herein, an annular groove 169 is formed around cavity 165 at lower end 160U of inner member 160. In the illustrated embodiment, annular groove 169 is discontinuous, being interrupted by fluid openings 168.

Extending upward from cylindrical sidewall 161 are a pair of spaced, curvilinear, and diametrically-opposed sidewall extensions 163, each having an upper portion 164 formed to define a circumferentially-projecting lug or stop element 164A at each circumferential end of upper portion 164. Each sidewall extension 163 can thus be described as being generally T-shaped, with a pair of diametrically-opposed sidewall openings 163A being formed between the two sidewall extensions 163. In combination, lugs 157A and 164A thus serve as travel-limiting means defining the maximum radial stroke of outer member 150 of piston assembly 140.

Figure 18B:
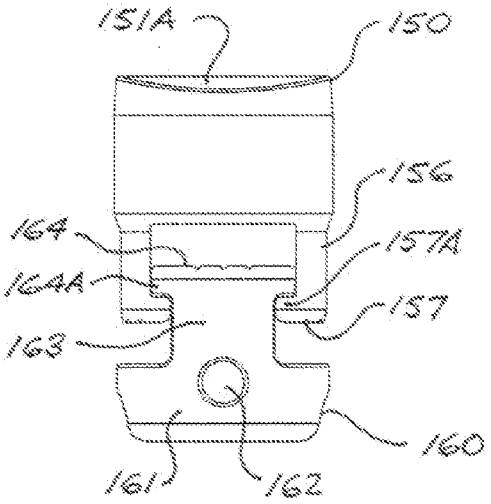
FIG. 18B is a side view of the piston assembly in FIGS. 17A and 17B, shown in an extended position.
Figure 19A:
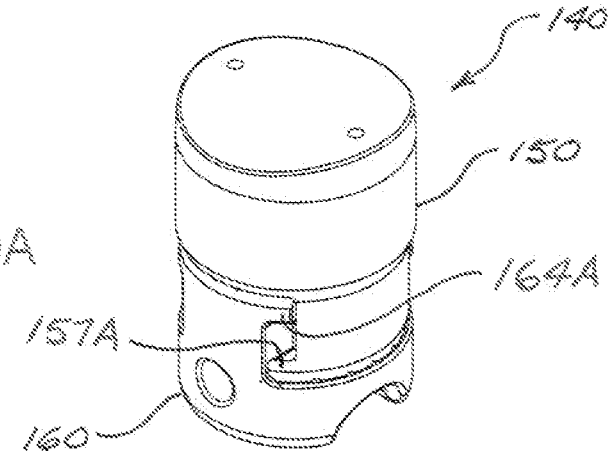
FIG. 19A is an isometric view of the piston assembly in FIGS. 17A-18B, shown in a retracted position.
Figure 19B:
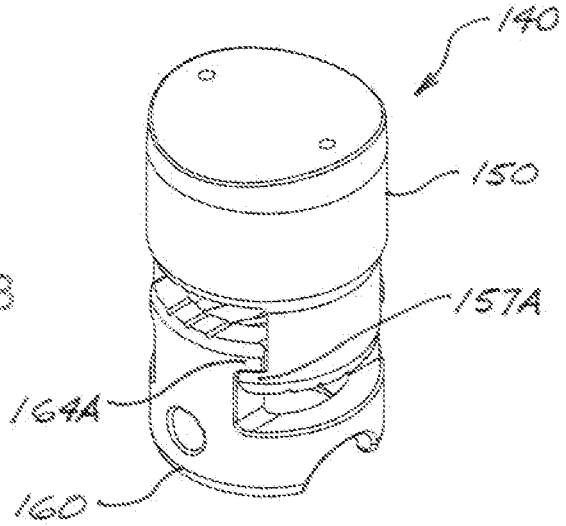
FIG. 19B is an isometric view of the piston assembly in FIGS. 17A-18B, shown in an extended position.
Figure 20A:
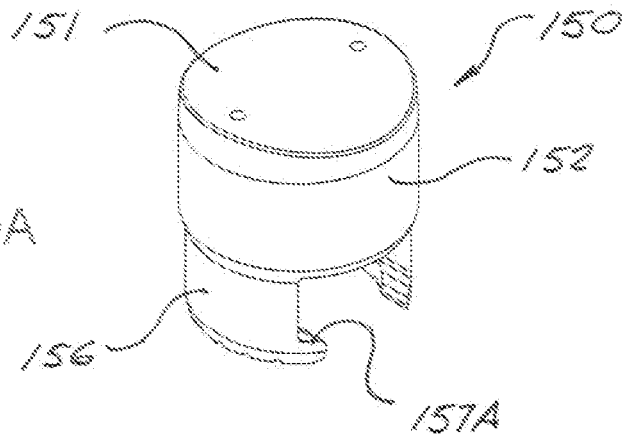
FIG. 20A is an isometric view of the outer member of the piston assembly in FIGS. 17A-19B.
Figure 20B:
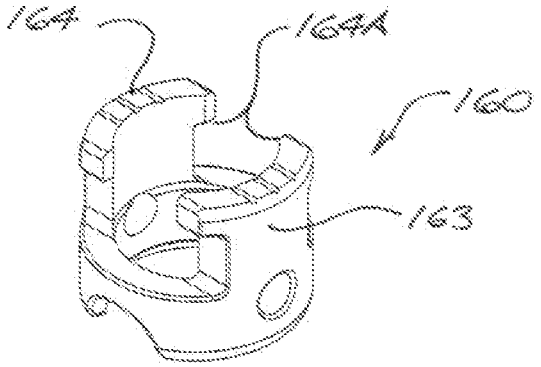
FIG. 20B is an isometric view of the inner member of the piston assembly in FIGS. 17A-19B.

As may be best understood with reference to FIGS. 18A, 18B, 19A, and 19B, outer member 150 and inner member 160 may be assembled by laterally inserting upper portions sidewall extensions 163 of inner member 160 into sidewall openings 156A of outer member 150 such that outer member 150 and inner member 160 are in coaxial alignment. Outer member 150 is axially movable relative to inner member 160 (i.e., radially relative to steering section 80), with the outward axial movement of outer member 150 being limited by the abutment of lugs 157A on outer member 150 against lugs 164A on inner member 160, as seen in FIGS. 17B, 18B, and 19B.

Figure 21:
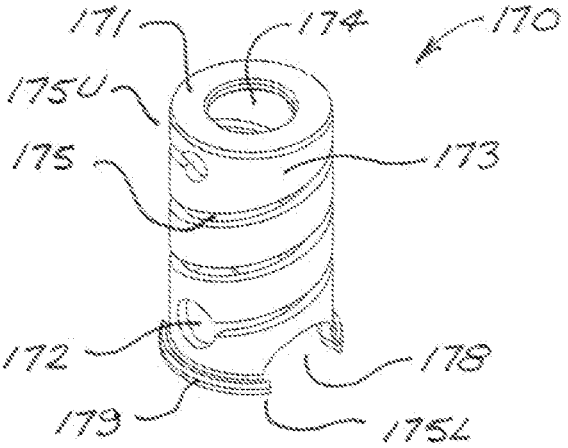
FIG. 21 is an isometric view of the biasing spring of the piston assembly in FIGS. 17A-19B.

Biasing spring 170, shown in isometric view in FIG. 21, comprises a cylindrical sidewall 173 having an upper end 173U and a lower end 173L, and defining a cylindrical inner chamber 174. Upper end upper end 173U of sidewall 173 is formed or provided with an inward-projecting annular flange 171, and lower end 173L of sidewall 173 is formed or provided with an outward-projecting annular lip 179. A helical slot 175 is formed through sidewall 173 such that sidewall 173 takes the form of a helical spring, with helical slot 175 having an upper terminus adjacent to annular flange 171 and a lower terminus adjacent to annular lip 179. A pair of diametrically-opposed retainer pin openings 172 are formed through sidewall 173 for receiving a retainer pin 145 when biasing spring 170 is assembled with inner member 160 of piston assembly 140 and installed in a steering section 80 (as will be described later herein). In the illustrated embodiment of spring 170, the lower terminus of helical slot 175 coincides with one of the retainer pin openings 172, but this is for convenience rather than for any functionally essential reason. A pair of diametrically-opposed fluid openings 168 (semi-circular or semi-ovate in the illustrated embodiment) are formed into sidewall 173, intercepting lower end 173L of sidewall 173 and at right angles to retainer pin openings 172, so as to be generally aligned with fluid openings 168 in sidewall 161 of inner member 160 when biasing spring 170 is assembled with inner member 160.

Figure 22:
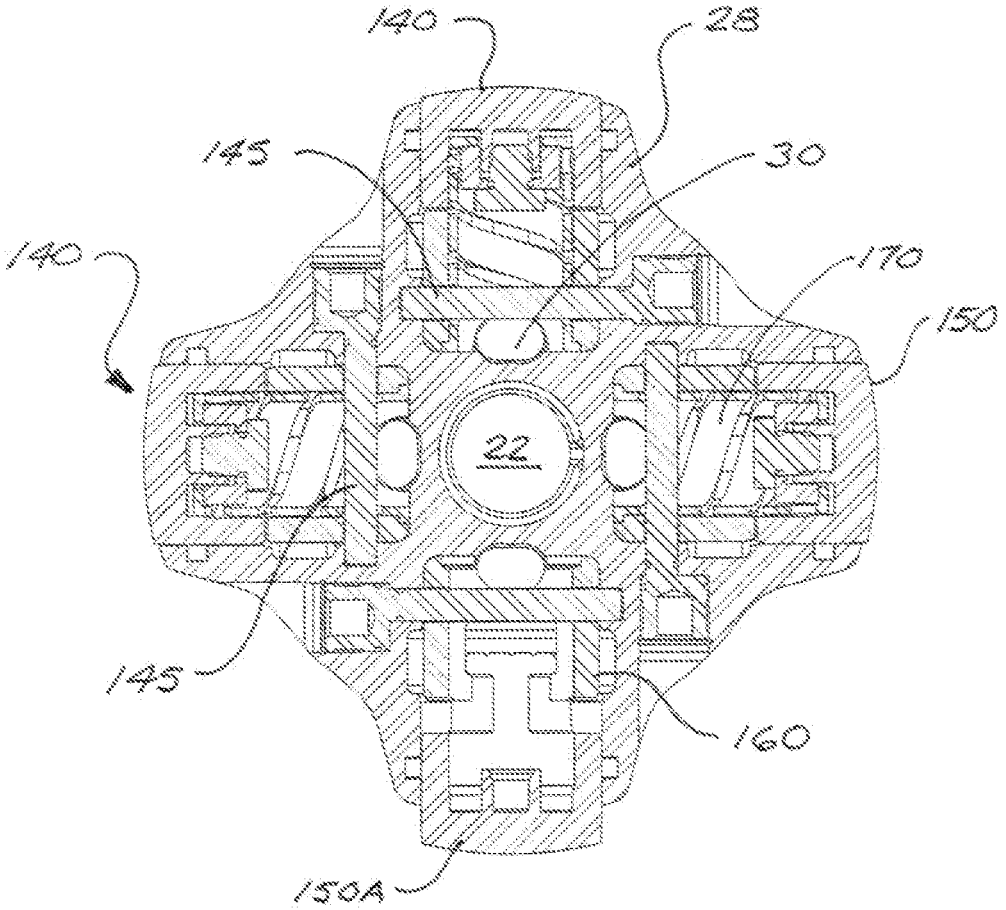
FIG. 22 is a transverse cross-section through the steering section of the drilling apparatus in FIG. 2, incorporating piston assemblies in accordance with FIGS. 17A-21.

The assembly of piston assembly 140 may be best understood with reference to FIGS. 17A, 17B, and 22. The first assembly step is to insert biasing spring 170 upward into cavity 165 of inner member 160 such that annular lip 179 on biasing spring 170 is retainingly engaged within annular groove 169 at lower end 160L of inner member 160. The next step is to assemble the sub-assembly of inner member 160 and biasing spring 170 with outer member 150, by inserting the upper end of biasing spring 170 into the lower end of outer member 150 such that flange 171 of biasing spring 170 is disposed within annular space 155 in outer member 150. A generally cylindrical spacer 180 having an inward-projecting annular flange 180A at its lower end is then positioned over and around cylindrical boss 153, and a cap screw 182 is inserted upward through the opening in spacer 180 and threaded into threaded cavity 154 in boss 153, thus securing spacer 180 and the upper end of biasing spring 170 to outer member 150.

Thus assembled, piston 140 incorporates biasing spring 170 with its upper (outer) end securely retained within outer member 150 and with its lower (inner) end securely retained by inner member 160. Accordingly, when a piston-actuating fluid flows into the associated fluid channel 30 in steering section 80, fluid will flow into piston 140 and exert pressure against cap member 151 of outer member 150, so as to overcome the biasing force of biasing spring 170 and extend outer member 150 radially outward from steering section 80. When the fluid pressure is relieved, biasing spring 170 will return outer member 150 to its retracted position as shown in FIGS. 17A and 18A. The magnitude of the biasing force provided by biasing spring 170 can be adjusted by adjusting the axial position of cap screw 182, and/or by using spacers 180 of different axial lengths.

The assembled piston(s) 140 can then be mounted into steering section 80 as shown in FIG. 22. Retainer pins 145 are inserted through transverse openings in steering section 80 and through retainer pin openings 162 and 172 in inner member 160 and biasing spring 170 respectively, thereby securing inner member 160 and the lower end of biasing spring 170 against radial movement relative to steering section 80.

The particular configuration of biasing spring 170 shown in the Figures, and the particular means used for assembling biasing spring 170 with outer member 150 and inner member 160, are by way of example only. Persons skilled in the art will appreciate that alternative configurations and assembly means may be devised in accordance with known techniques, and such alternative configurations and assembly means are intended to come within the scope of the present disclosure.

Piston assembly 140 provides significant benefits and advantages over existing piston designs. The design of piston assembly 140 facilitates a long piston stroke within a comparatively short piston assembly, with a high mechanical return force provided by the integrated biasing spring 170. This piston assembly is also less prone to debris causing pistons to bind within the steering section or limiting piston stroke when operating in dirty fluid environments. It also allows a spring-preloaded piston assembly to be assembled and secured in place within the steering section using a simple pin, without the need to preload the spring during insertion into the steering section, making the piston assembly easier to service or replace.

It will be readily appreciated by those skilled in the art that various modifications of embodiments taught by the present disclosure may be devised without departing from the teaching and scope of the present disclosure, including modifications that use equivalent structures or materials hereafter conceived or developed. It is especially to be understood that the present disclosure is not intended to be limited to any described or illustrated embodiment, and that the substitution of a variant of a claimed element or feature, without any substantial resultant change in operation, will not constitute a departure from the scope of the present disclosure. It is also to be appreciated that the different teachings of the embodiments described and discussed herein may be employed separately or in any suitable combination to produce different embodiments providing desired results.

Persons skilled in the art will also appreciate that components of disclosed embodiments that are described or illustrated herein as unitary components could also be built up from multiple subcomponents without material effect on function or operation, unless the context clearly requires such components to be of unitary construction. Similarly, components described or illustrated as being assembled from multiple subcomponents may be provided as unitary components unless the context requires otherwise.

In this patent document, any form of the word "comprise" is to be understood in its non-limiting sense to indicate that any item following such word is included, but items not specifically mentioned are not excluded. A reference to an element by the indefinite article "a" does not exclude the possibility that more than one such element is present, unless the context clearly requires that there be one and only one such element.

Any use of any form of the terms "connect", "engage", "couple", "attach", or other terms describing an interaction between elements is not intended to limit such interaction to direct interaction between the subject elements, and may also include indirect interaction between the elements such as through secondary or intermediary structure.

Relational terms such as "parallel", "perpendicular", "coincident", "intersecting", "equal", "coaxial", and "equidistant" are not intended to denote or require absolute mathematical or geometrical precision. Accordingly, such terms are to be understood as denoting or requiring substantial precision only (e.g., "substantially parallel") unless the context clearly requires otherwise.

Wherever used in this document, the terms "typical" and "typically" are to be interpreted in the sense of representative or common usage or practice, and are not to be understood as implying essentiality or invariability.

In this patent document, certain components of disclosed RSS tool embodiments are described using adjectives such as "upper" and "lower". Such terms are used to establish a convenient frame of reference to facilitate explanation and enhance the reader's understanding of spatial relationships and relative locations of the various elements and features of the components in question. The use of such terms is not to be interpreted as implying that they will be technically applicable in all practical applications and usages of RSS tools in accordance with the present disclosure, or that such sub tools must be used in spatial orientations that are strictly consistent with the adjectives noted above. For example, RSS tools in accordance with the present disclosure may be used in drilling horizontal or angularly-oriented wellbores. For greater certainty, therefore, the adjectives "upper" and "lower", when used with reference to an RSS tool, should be understood in the sense of "toward the upper (or lower) end of the drill string", regardless of what the actual spatial orientation of the RSS tool and the drill string might be in a given practical usage. The proper and intended interpretation of the adjectives "inner", "outer", "upper", and "lower" for specific purposes of illustrated piston assemblies and components thereof will be apparent from corresponding portions of the Detailed Description.

What is claimed is:

1. A rotary steerable drilling apparatus comprising:

a control assembly disposed within a cylindrical housing;

a steering section having a central axis, a first end coupled to the housing, a second end, a central channel, and one or more fluid channels radially-spaced from the central channel;

one or more radially extendable pistons housed in the steering section;

wherein the central channel extends axially from the first end and is configured to flow drilling fluid through the steering section;

wherein each of the fluid channels extends to one of the pistons and is configured to flow drilling fluid to the corresponding piston; and a fluid-metering assembly configured to selectively meter the flow of drilling fluid into one or more of the fluid channels of the steering section;

wherein the fluid-metering assembly includes a first component coupled to the control assembly and a second component coupled to the steering section;

wherein the second component includes a central through bore and one or more fluid inlets disposed about the central through bore, wherein the central through bore of the second component is in fluid communication with the central channel of the steering section;

wherein each fluid inlet of the second component is in fluid communication with at least one fluid channel of the steering section;

wherein the control assembly is configured to move the first component relative to the second component to control the flow of drilling fluid into one or more of the fluid inlets of the second component;

wherein the first component comprises a flange and a sleeve extending axially from the flange;

wherein the sleeve extends into the central through bore of the second component and slidingly engages the lower component.

2. The rotary steerable drilling apparatus of claim 1, wherein the first end of the steering section is coupled to a lower end of the housing; and wherein the first component is positioned axially above the second component.

3. The rotary steerable drilling apparatus of claim 2, wherein the second end of the steering section comprises a cutting structure.

4. The rotary steerable drilling apparatus of claim 1, wherein the first component includes a central through bore extending axially through the flange and the sleeve, and a fluid-metering opening extending radially through the sleeve;

wherein the central through bore of the first component is in fluid communication with the central through bore of the second component.

5. The rotary steerable drilling apparatus of claim 4, wherein the control assembly is configured to rotate the first component relative to the second component to place the fluid-metering opening of the first component into fluid communication with each fluid inlet of the lower component in sequence.

6. The rotary steerable drilling apparatus of claim 4, wherein the control assembly is configured to move the first component axially relative to the second component between:

a first position allowing drilling fluid to flow from the central through bore of the first component into all of the fluid inlets of the second component simultaneously;

a second position allowing drilling fluid to flow from the central through bore of the first component into at least one of the fluid inlets of the lower component at a time.

7. The rotary steerable drilling apparatus of claim 6, wherein the control assembly is configured to move the first component axially relative to the second component between the first position, the second position, and a third position preventing drilling fluid from flowing from the central through bore of the first component into any of the fluid inlets of the second component.

8. The rotary steerable drilling apparatus of claim 1, further comprising one or more reaction pads coupled to the steering section, wherein one reaction pad is provided for each piston;

wherein each piston is configured to deflect the corresponding reaction pad radially away from the steering section in response to the flow of drilling fluid through the corresponding fluid channel.

9. The rotary steerable drilling apparatus of claim 8, wherein each reaction pad comprises a flexible member resiliently mounted to the steering section.

10. The rotary steerable drilling apparatus of claim 8, wherein each reaction pad comprises a hinged member pivotally coupled to the steering section and configured to pivot about a hinge axis oriented parallel to the central axis of the steering section.

11. The rotary steerable drilling apparatus of claim 1, further comprising a biasing means for each piston, wherein each biasing means is configured to bias the piston to a radially retracted position within the steering section.

12. The rotary steerable drilling apparatus of claim 1, wherein at least one of the one or more pistons is a two-piece piston assembly comprising:

an inner member fixably coupled to the steering section; and an outer member disposed about the inner member and configured to move radially relative to the inner member and the steering section.

13. The rotary steerable drilling apparatus of claim 12, wherein the two-piece piston assembly includes a travel-limiting means for restricting the radial stroke of the outer member relative to the inner member and the steering section.

14. The rotary steerable drilling apparatus of claim 13, wherein the travel-limiting means comprises a plurality of first stop elements formed on the outer member and a plurality of second stop elements formed on the inner member, the first and second stop elements being configured and arranged such that each first stop element will react against one of the second stop elements when the stroke of the outer member reaches a preset limit.

15. The rotary steerable drilling apparatus of claim 1, wherein the control assembly is configured to be separated from the steering section with the first component remaining coupled to the control assembly.

16. The rotary steerable drilling apparatus of claim 1, wherein the first component includes a central through bore extending axially through the flange and the sleeve of the first component;

wherein the central through bore of the first component and the central through bore of the second component are in fluid communication with the central channel of the steering section.

17. A rotary steerable drilling apparatus comprising:

a steering section having a central axis, a first end, a second end comprising a cutting structure, a central channel, and a plurality of circumferentially-spaced fluid channels disposed about the central channel;

a plurality of pistons housed in the steering section;

wherein the central channel extends axially from the first end of the steering section and is configured to flow drilling fluid through the steering section to the cutting structure;

wherein each of the fluid channels extends from the first end of the steering section to at least one of the pistons;

wherein each piston is configured to move radially outward in response to drilling fluid supplied by one or more of the fluid channels;

a fluid-metering assembly including a lower component fixably coupled to the steering section and an upper component coupled to a control assembly;

wherein the upper component includes a central through bore in fluid communication with the central channel of the steering section;

wherein the lower component includes a central through bore and a plurality of circumferentially-spaced fluid inlets disposed about the central through bore, wherein the central through bore of the lower component is in fluid communication with the central through bore of the upper component and the central channel of the steering section, wherein the central through bore of the upper component and the central through bore of the lower component are configured to continuously flow drilling fluid through the central channel of the steering section to the cutting structure, wherein each fluid inlet of the lower component is in fluid communication with at least one fluid channel of the steering section;

wherein the control assembly is configured to move the upper component relative to the lower component to control the distribution of drilling fluid between the central through bore of the lower component and the fluid inlets of the lower component.

18. The rotary steerable drilling apparatus of claim 17, wherein the upper component comprises a flange and a sleeve extending axially from the flange;

wherein the sleeve extends into the central through bore of the lower component and slidingly engages the lower component.

19. The rotary steerable drilling apparatus of claim 18, wherein the upper component includes a central through bore extending axially through the flange and the sleeve, and a fluid-metering opening extending radially from the central through bore to a radially outer surface of the sleeve;

wherein the central through bore of the upper component is in fluid communication with the central through bore of the lower component.

20. The rotary steerable drilling apparatus of claim 19, wherein the control assembly is configured to rotate the upper component relative to the lower component to place the fluid-metering opening of the upper component into fluid communication with at least one of the fluid inlets of the lower component.

21. The rotary steerable drilling apparatus of claim 19, wherein the control assembly is configured to move the upper component axially relative to the lower component between:

an upper position allowing drilling fluid to flow from the central through bore of the upper component into all of the fluid inlets of the lower component simultaneously; and an intermediate position allowing drilling fluid to flow from the central through bore of the upper component into at least one of the fluid inlets of the lower component at a time.

22. The rotary steerable drilling apparatus of claim 21, wherein the control assembly is configured to move the upper component axially relative to the lower component between the upper position, the intermediate position, and a lower position preventing drilling fluid from flowing from the central through bore of the upper component into any of the fluid inlets of the lower component.

23. The rotary steerable drilling apparatus of claim 17, wherein the upper component comprises an upper plate having a central through bore extending axially through the upper plate and an arcuate fluid-metering hole extending axially through the upper plate, wherein the fluid-metering hole is radially offset from the central through bore of the upper plate.

24. The rotary steerable drilling apparatus of claim 23, wherein the control assembly is configured to rotate the upper plate relative to the lower component to place the fluid-metering hole of the upper plate into fluid communication with at least one of the fluid inlets of the lower component.

25. The rotary steerable drilling apparatus of claim 24, wherein the control assembly is configured to move the upper plate axially away from the lower component to allow drilling fluid to flow through the central opening of the upper plate and into all of the fluid inlets of the lower plate simultaneously.

26. The rotary steerable drilling apparatus of claim 17, further comprising one or more reaction pads coupled to the steering section, wherein one reaction pad is provided for each piston;

wherein each piston is configured to deflect the corresponding reaction pad radially away from the steering section in response to the flow of drilling fluid through the corresponding fluid channel.

27. The rotary steerable drilling apparatus of claim 17, further comprising a biasing means for each piston, wherein each biasing means is configured to bias the piston to a radially retracted position within the steering section.

28. The rotary steerable drilling apparatus of claim 17, wherein at least one of the one or more pistons is a two-piece piston assembly comprising:

an inner member fixably coupled to the steering section; and an outer member disposed about the inner member and configured to move radially relative to the inner member and the steering section.

29. The rotary steerable drilling apparatus of claim 28, wherein the two-piece piston assembly includes a travel-limiting means for restricting the radial stroke of the outer member relative to the inner member and the steering section.

30. A method for drilling a borehole with a drill bit having a cutting structure, the method comprising:

(a) flowing drilling fluid to a steering section having a central axis, a first end, and a second end opposite the first end, wherein the second end comprises the cutting structure;

(b) selectively distributing the drilling fluid supplied to the steering section with a fluid-metering assembly, wherein the fluid-metering assembly includes a first component and a second component;

(c) continuously flowing drilling fluid through a central passage in the first component, a central passage in the second component, and a central channel in the steering section to the cutting structure;

(d) flowing drilling fluid through an outlet of the first component, a first inlet of the second component, and a first fluid channel in the steering section to a first piston housed in the steering section while flowing drilling fluid to the cutting structure in (c); and (e) moving the first piston radially outward from the steering section during (d).

31. The method of claim 30, further comprising:

(f) flowing drilling fluid through the outlet of the first component, a second inlet of the second component, and a second fluid channel in the steering section to a second piston housed in the steering section after (d) and while flowing drilling fluid to the cutting structure in (c);

(g) moving the second piston radially outward from the steering section during (f).

32. The method of claim 31, wherein (d) comprises rotating the first component to a first position aligning the outlet with the first inlet, and (f) comprise rotating the first component to a second position aligning the outlet with the second inlet.

33. The method of claim 31, further comprising:

(h) flowing drilling fluid through the first component into both the first inlet and the second inlet simultaneously.

34. The method of claim 33, further comprising extending the first piston and the second piston radially outward from the steering section to centralize the drill bit in the borehole during (h).

35. The method of claim 33, further comprising:

flowing drilling fluid through the first component and the second component while restricting drilling fluid from flowing into the first inlet and the second inlet.

36. The method of claim 30, wherein the outlet extends radially through the first component.

37. The method of claim 30, wherein the outlet extends axially through the first component and the first inlet extends axially through the second component.

38. The method of claim 30, further comprising rotating the first component relative to the second component to place the outlet in fluid communication with the first inlet.

39. A method for drilling a borehole with a drill bit having a cutting structure, the method comprising:

(a) flowing drilling fluid to a steering section having a central axis, a first end, and a second end opposite the first end, wherein the second end comprises the cutting structure;

(b) selectively distributing the drilling fluid supplied to the steering section with a fluid-metering assembly, wherein the fluid-metering assembly includes a first component and a second component;

(c) continuously flowing drilling fluid through the first component, the second component, and the steering section to the cutting structure;

(d) flowing drilling fluid through an outlet of the first component, a first inlet of the second component, and a first fluid channel in the steering section to a first piston housed in the steering section while flowing drilling fluid to the cutting structure in (c); and (e) moving the first piston radially outward from the steering section during (d);

(f) moving the first component axially relative to the second component to place the outlet in fluid communication with the first inlet.

40. The method of claim 39, wherein (c) comprises continuously flowing drilling fluid through a central passage in the first component, a central passage in the second component, and a central channel in the steering section to the cutting structure.

* * * * *